US009027453B2

(12) United States Patent
Ueda et al.

(10) Patent No.: US 9,027,453 B2
(45) Date of Patent: May 12, 2015

(54) BLAST TREATMENT METHOD AND BLAST TREATMENT DEVICE

(75) Inventors: Masaya Ueda, Kobe (JP); Kenji Koide, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 149 days.

(21) Appl. No.: 13/820,750

(22) PCT Filed: Oct. 11, 2011

(86) PCT No.: PCT/JP2011/005691

§ 371 (c)(1),
(2), (4) Date: Mar. 5, 2013

(87) PCT Pub. No.: WO2012/049834

PCT Pub. Date: Apr. 19, 2012

(65) Prior Publication Data

US 2013/0160635 A1 Jun. 27, 2013

(30) Foreign Application Priority Data

Oct. 13, 2010 (JP) ..... 2010-230923

(51) Int. Cl.
*F42B 33/00* (2006.01)
*F42B 33/06* (2006.01)
(Continued)

(52) U.S. Cl.
CPC . *F42B 33/06* (2013.01); *F42D 5/04* (2013.01); *F42D 5/045* (2013.01); *F42D 3/00* (2013.01)

(58) Field of Classification Search
USPC ..... 86/50; 822/299, 401, 403; 89/1.13; 102/402
See application file for complete search history.

(56) References Cited

U.S. PATENT DOCUMENTS 6,881,383 B1 4/2005 Tschritter et al.
7,398,720 B2 * 7/2008 Fujiwara et al. ..... 86/50
(Continued)

FOREIGN PATENT DOCUMENTS

DE 10115950 C1 6/2002
EP 1734334 A1 12/2006
(Continued)

OTHER PUBLICATIONS

International Search Report for corresponding International Application No. PCT/JP2011/005691, Dec. 20, 2011.
(Continued)

*Primary Examiner* — Gabriel Klein
(74) *Attorney, Agent, or Firm* — Studebaker & Brackett PC

(57) ABSTRACT

A blast treatment method capable of more reliably treating an object to be treated which is accommodated in an outer container is provided. The blast treatment method includes: a step for spacing a plurality of blasting explosives (20) from one another at positions on the outer side surface of an outer container (60) in a direction surrounding a central axis (C2) of the outer container (60) and arranging the blasting explosives (20) in such a manner as to extend approximately parallel to the central axis (C2); a step for installing the outer container (60) within a chamber (90); and a step for detonating the blasting explosives (20) within the chamber to perform blast treatment of an object (10) to be treated with the detonation energy, wherein the blasting explosives (20) are detonated at the blast timing at which fragments of the outer container (60) or shock waves, which are generated in the vicinity of the blasting explosives (20) by the detonation energy of the blasting explosives (20), collide with or propagate to a bombshell (10) in less time difference than that in the case in which the plurality of blasting explosives (20) are detonated at the same time.

17 Claims, 9 Drawing Sheets

(51) Int. Cl.

| | |
|---|---|
| ***F42D 5/04*** | (2006.01) |
| ***F42D 5/045*** | (2006.01) |
| ***F42D 3/00*** | (2006.01) |

(56) References Cited

U.S. PATENT DOCUMENTS

| | | | | |
|---|---|---|---|---|
| 8,387,503 | B2 * | 3/2013 | Lesage et al. | 86/50 |
| 8,448,554 | B2 * | 5/2013 | Koide et al. | 86/50 |
| 8,453,550 | B2 * | 6/2013 | Koide et al. | 86/50 |
| 8,464,624 | B2 * | 6/2013 | Asahina et al. | 86/50 |
| 8,468,945 | B2 * | 6/2013 | Koide et al. | 102/293 |
| 8,495,944 | B2 * | 7/2013 | Koide et al. | 86/50 |
| 8,516,937 | B2 * | 8/2013 | Koide et al. | 86/50 |
| 8,671,814 | B2 * | 3/2014 | Fujiwara et al. | 86/50 |
| 2007/0151437 | A1 | 7/2007 | Fujiwara et al. | |
| 2012/0017750 | A1 | 1/2012 | Koide et al. | |

FOREIGN PATENT DOCUMENTS

| | | | |
|---|---|---|---|
| EP | 2416107 | A1 | 2/2012 |
| FR | 2931229 | A1 | 11/2009 |
| JP | 2003-090700 | | 3/2003 |
| JP | 2005-291514 | | 10/2005 |
| JP | 2009-544924 | | 12/2009 |
| WO | WO 2010/113424 | | 10/2010 |
| WO | WO 2010/113425 | | 10/2010 |
| WO | WO 2010/113426 | | 10/2010 |
| WO | WO 2010/113429 | | 10/2010 |

OTHER PUBLICATIONS

Written Opinion for corresponding International Application No. PCT/JP2011/005691, Dec. 20, 2011.

The extended European search report issued by the European Patent Office on Apr. 22, 2014, which corresponds to EP11832278.3-1655 and is related to U.S. Appl. No. 13/820,750.

* cited by examiner

BLAST TREATMENT METHOD AND BLAST TREATMENT DEVICE

TECHNICAL FIELD

The present invention relates to a blast treatment method for blasting an object to be treated such as military ammunition and a blast treatment device for the same.

BACKGROUND ART

Military ammunition (such as artillery shells, bombs, landmines, and underwater mines) includes, for example, a shell made of steel and a bursting charge or a chemical agent contained within the shell.

The ammunition is blasted by, for example, blasting explosives. When the detonation energy of blasting explosives is supplied to the ammunition, the shell is broken, the bursting charge is exploded, and the chemical agent is rendered harmless. The treatment method through the blasting needs no disassembling work. For this reason, the method allows for a disposal of not only well-preserved ammunition but also ammunition such as those that are difficult to disassemble due to age deterioration or deformation. When the ammunition containing chemical agents hazardous to human bodies is treated by the above-described treatment method, nearly all the chemical agents are decomposed due to ultrahigh temperature and ultrahigh pressure fields generated by the detonation of blasting explosives. An example of such blast treatment is disclosed in Patent Literature 1.

In the method disclosed in Patent Literature 1, a treatment subject is placed in a container, and ANFO explosives are disposed around the treatment subject inside the container, which is further wrapped by a sheet shaped explosive whose detonation velocity is greater than those of the ANFO explosives. Then, detonation of the sheet shaped explosive is initiated at a predetermined end thereof. Upon the initiation, the sheet shaped explosive detonates along a given direction. The detonation of the sheet shaped explosive triggers subsequent detonation of the ANFO explosives in a given direction. Detonation energy of the ANFO explosives is supplied to the treatment subject.

In this method, because the ANFO explosives are detonated almost at the same time around the treatment subject, the detonation energy of the ANFO explosives is caused to concentrate on the bursting charge within the shell. This leads to a slowdown in velocity of fragments of the shell, which are blown outward of the bursting charge by received detonation energy of the bursting charge.

CITATION LIST

Patent Document

Patent Document 1: Japan Patent Laid-Open Publication No. 2005-291514

SUMMARY OF INVENTION

Problem to be Solved by the Invention

However, the conventional blast treatment method disclosed in Patent Literature 1 is a method for treating ammunition only. It is thus necessary that when the method is applied to ammunition that contains a chemical agent, and is housed in an outer container to prevent the chemical agent from leaking out, the ammunition be extracted from the outer container. During the extraction, the chemical agent carries a potential risk of being leaked to the outside.

The present invention, which was conceived in view of the above-described point, aims to provide a blast treatment method and a blast treatment device capable of treating a treatment subject, which is housed within an outer container, with greater certainty under a condition that the treatment subject remains housed in the outer container.

Means to Solve the Problems

To attain the aim set forth above, the present invention provides a blast treatment method for blast-treating a treatment subject containing a treating explosive formed to extend along a specific direction, a shell that has a central axis extending along a predetermined direction and houses therein the treating explosive in an orientation where the treating explosive extends along the central axis of the shell, and a chemical agent filled so as to surround the treating explosive inside the shell. In the method, the treatment subject is housed within an outer container extending along a predetermined axial direction in an orientation where the central axis of the outer container and the central axis of the shell extend substantially parallel to each other while being displaced from each other in a direction substantially orthogonal to the central axes themselves. The method comprises a blasting explosive placement step of placing a plurality of blasting explosives used for blasting the treatment subject at positions on an exterior surface of the outer container in such a manner that the blasting explosives are spaced apart from each other in a direction surrounding the central axis of the outer container and arranged to extend substantially parallel to the central axis of the outer container, an installation step of installing, within a sealable chamber, the outer container in which the treatment subject is housed, and a blast step of detonating the plurality of blasting explosives, and causing the treatment subject to be blasted by detonation energy of each of the blasting explosives. Further, in the blast step, each of the blasting explosives is separately detonated at a detonation timing at which fragments of the outer container or shock waves created in a vicinity of each blasting explosive by the detonation energy of the blasting explosive collide against the shell with a temporal difference smaller than that caused when the plurality of blasting explosives are simultaneously detonated.

According to this method, the detonation energy can be concentrated on the treatment subject while preventing the chemical agent from leaking outside, so that safe and reliable treatment of the treatment subject can be achieved.

DESCRIPTION OF EMBODIMENTS

Figure 1:
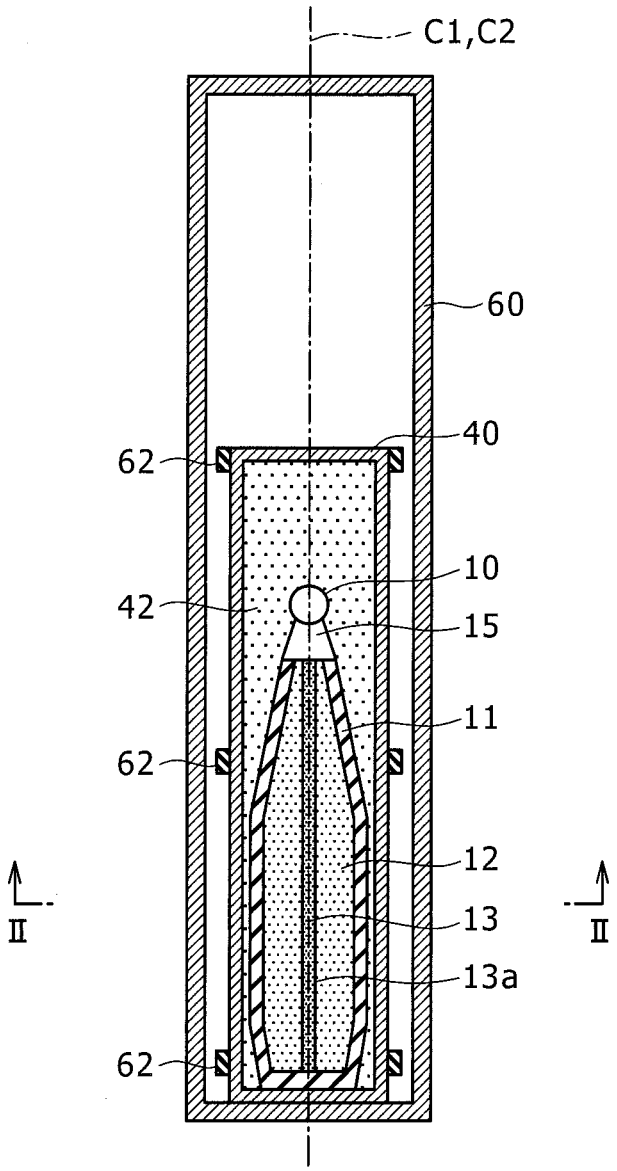
FIG. 1 A longitudinal section view showing a condition in which a treatment subject to be blasted by a blast treatment method according to this invention is housed within an inner container and an outer container.
Figure 2:
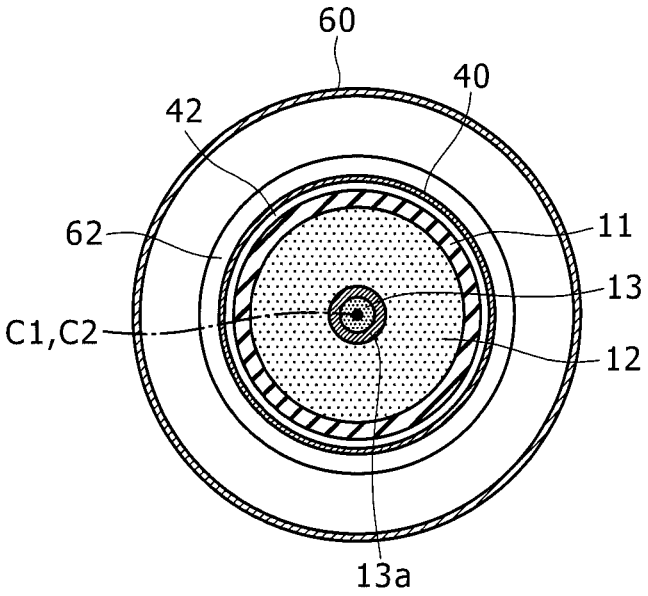
FIG. 2 A section view taken along a line II-II in FIG. 1.

Hereinafter, an embodiment of a blast treatment method according to the present invention will be described with reference to drawings. FIG. 1 is a longitudinal section view showing an example of a chemical ammunition 10, which is a treatment subject to be blast-treated by the blast treatment method according to this embodiment. FIG. 1 shows a condition in which the chemical ammunition 10 is housed within an inner container 40 inside an outer container 60. FIG. 2 is a section view taken along a line II-II in FIG. 1.

The chemical ammunition 10 includes a shell 11, a burster tube 13*a*, a bursting charge 13, a chemical agent 12, and a fuze 15. The shell 11 is a hollow component extending along a specific direction. The burster tube 13*a* is composed of steel and housed inside the shell 11. The bursting charge 13 is stored within the burster tube 13*a*. The chemical agent 12 is a hazardous substance contained within the shell 11. The fuze 15 is fixed to a longitudinal front end of the shell 11.

An outer circumferential surface (an exterior surface) of the shell 11 is in a shape of a cylinder whose central axis is defined as an axis C1 extending along a specific direction. In the example shown in FIG. 1, the outer circumferential surface of the shell 11 is broadened toward a radial outside in its front portion lying from the front end to a substantial midsection in a longitudinal direction as it approaches the rear. In the outer circumferential surface of the shell 11, a portion lying from the substantial midsection in the longitudinal direction to a rear end extends in parallel with the central axis C1. The bursting charge 13 is stored within the shell 11 in an orientation extending along the central axis C1. The chemical agent 12 is filled between an interior surface of the shell 11 and the steel burster tube 13*a*. The chemical agent 12 surrounds the steel burster tube 13*a* and the bursting charge 13.

The chemical agent 12 is most likely to have a detrimental effect on human bodies and others. With this in view, the chemical ammunition 10 is housed within the outer container 60 in a sealed condition to keep the chemical agent 12 from leaking to the outside. Especially, in the example shown in FIG. 1, for more reliable protection of the chemical agent 12 against leakage, the chemical ammunition 10 is stored within the inner container 40 in the sealed state, and the inner container 40 is further housed inside the outer container 60 in the sealed state.

The inner container 40 is a hollow component. An outer circumferential surface of the inner container 40 is in the shape of a cylinder running around the central axis C1. In the inner container 40, the central axis C1 of the chemical ammunition 10 extends along the central axis of the inner container 40. In other words, the chemical ammunition 10 and the inner container 40 are coaxial. In the example shown in FIG. 1, the chemical ammunition 10 is externally covered with a cushioning material 42 such as a polyethylene sheet inside the inner container 40. In this embodiment, the cushioning material 42 is undeformable. Because of this, even when the orientation of the chemical ammunition 10 is changed, the central axis C1 of the chemical ammunition 10 is maintained in the state where it runs along the central axis of the inner container 40. In the example illustrated in FIG. 1, three flanges 62 are externally attached to the inner container 40. Each flange 62 is spaced apart from another flange in the axial direction of the inner container 40.

The outer container 60 is a hollow component. An outer circumferential surface (an exterior surface) of the outer container 60 is in the shape of a cylinder running around the central axis C2. Inside the outer container 60, the central axis C1 of the inner container 40 in which the chemical ammunition 10 is housed extends in parallel with the central axis C2 of the outer container 60. In the example shown in FIG. 1, there exists air between the outer circumferential surface of the inner container 40 and an interior surface of the outer container 60. Inside the outer container 60, each of the central axes C1 and C2 of the inner container 40 and the outer container 60 lies along a vertical direction. Depending on a placement or other conditions of the inner container 40, the central axes C1 and C2 may be variously situated at any position in the outer container 60. Note that the example is shown in FIG. 1 in which the central axes C1 and C2 are collinear.

Hereinafter, a condition in which each central axis C1, C2 of the chemical ammunition 10, the inner container 40, and the outer container 60 extends along the vertical direction may be referred to as being vertically orientated in some cases. A condition in which each central axis C1, C2 of the chemical ammunition 10, the inner container 40, and the outer container 60 extends along a horizontal direction may be, in some cases, referred to as being horizontally oriented.

Figure 3:
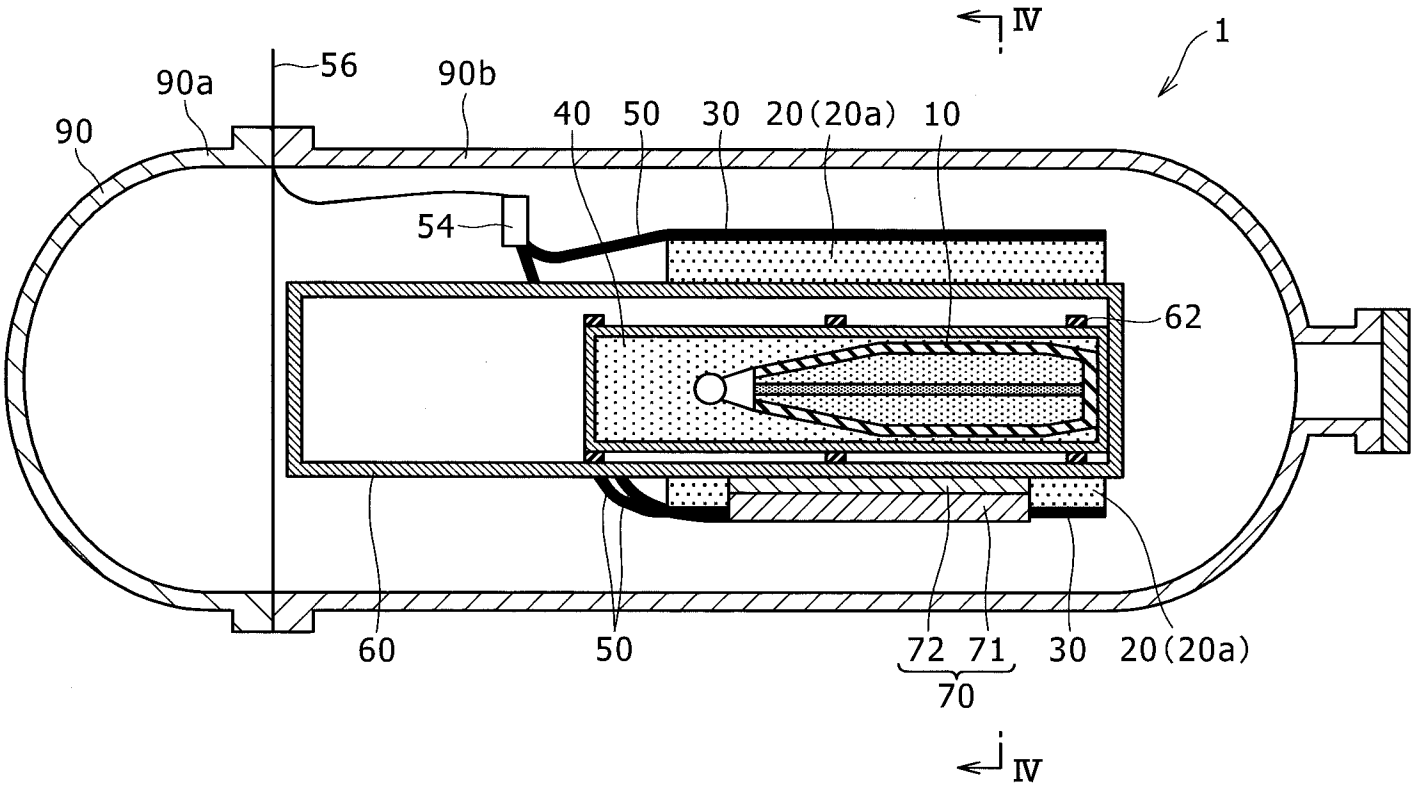
FIG. 3 A longitudinal section view of a blast treatment device according to an embodiment of this invention.
Figure 4:
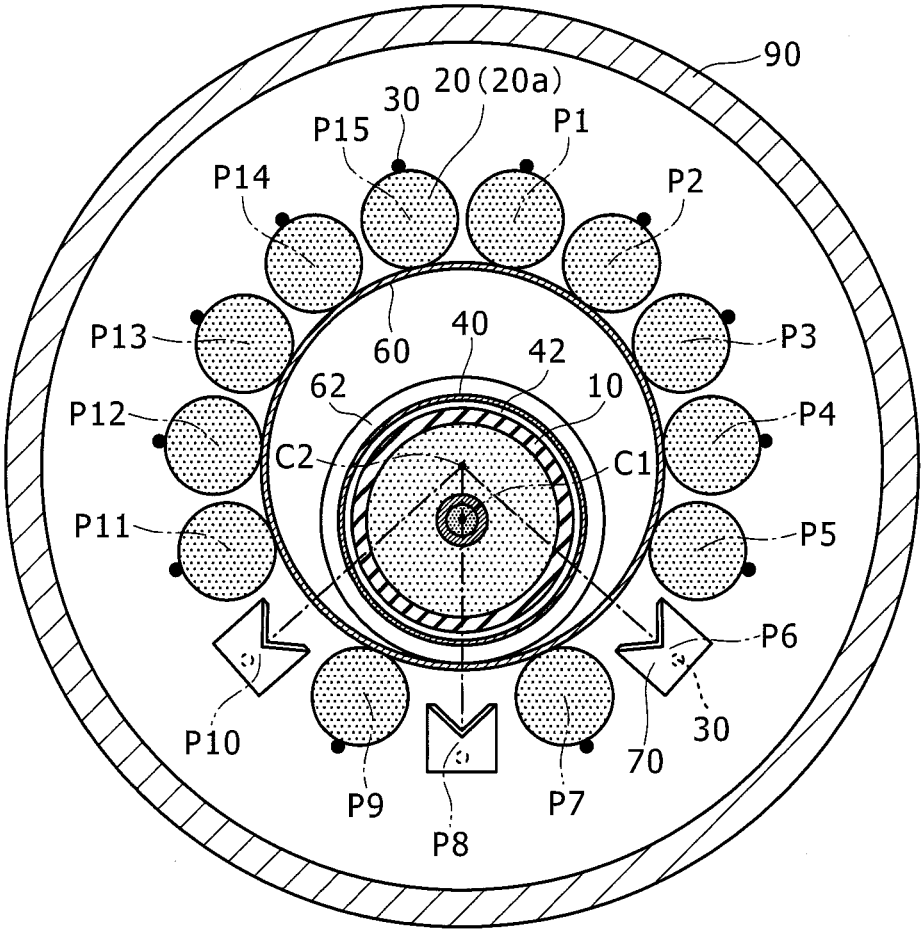
FIG. 4 A section view taken along a line IV-IV in FIG. 3.
Figure 5:
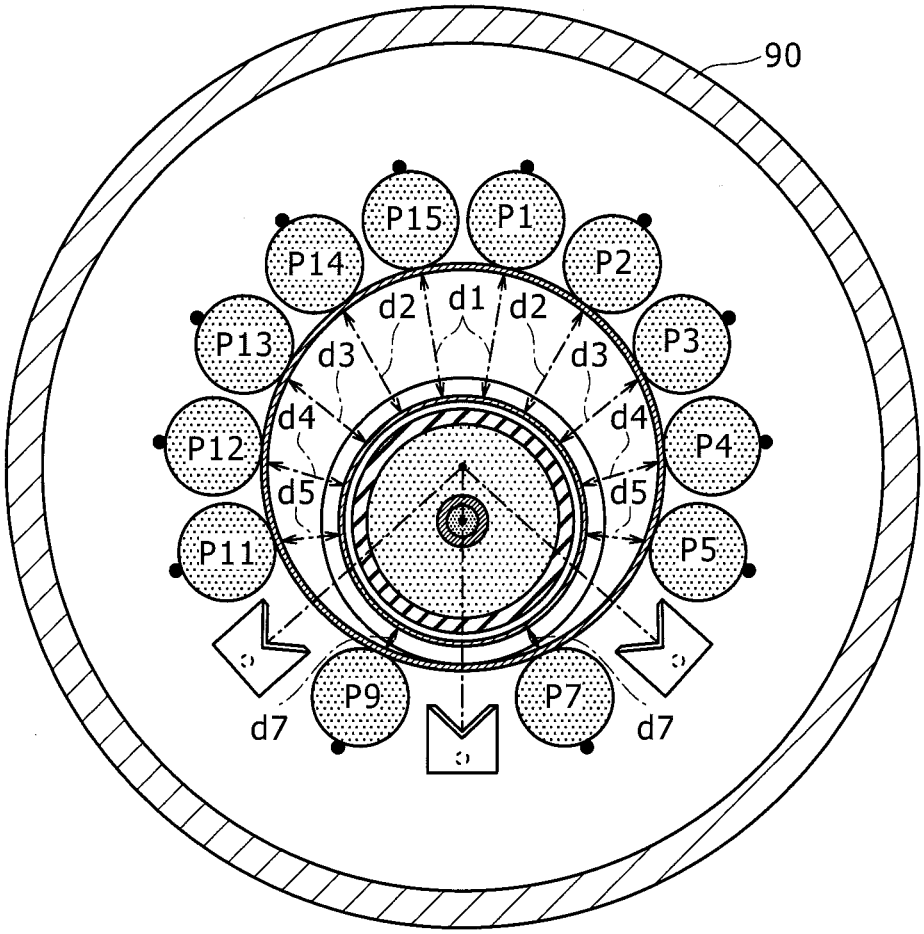
FIG. 5 A drawing for explaining distances from blasting explosives to the inner container in the condition shown in FIG. 4.
Figure 6:
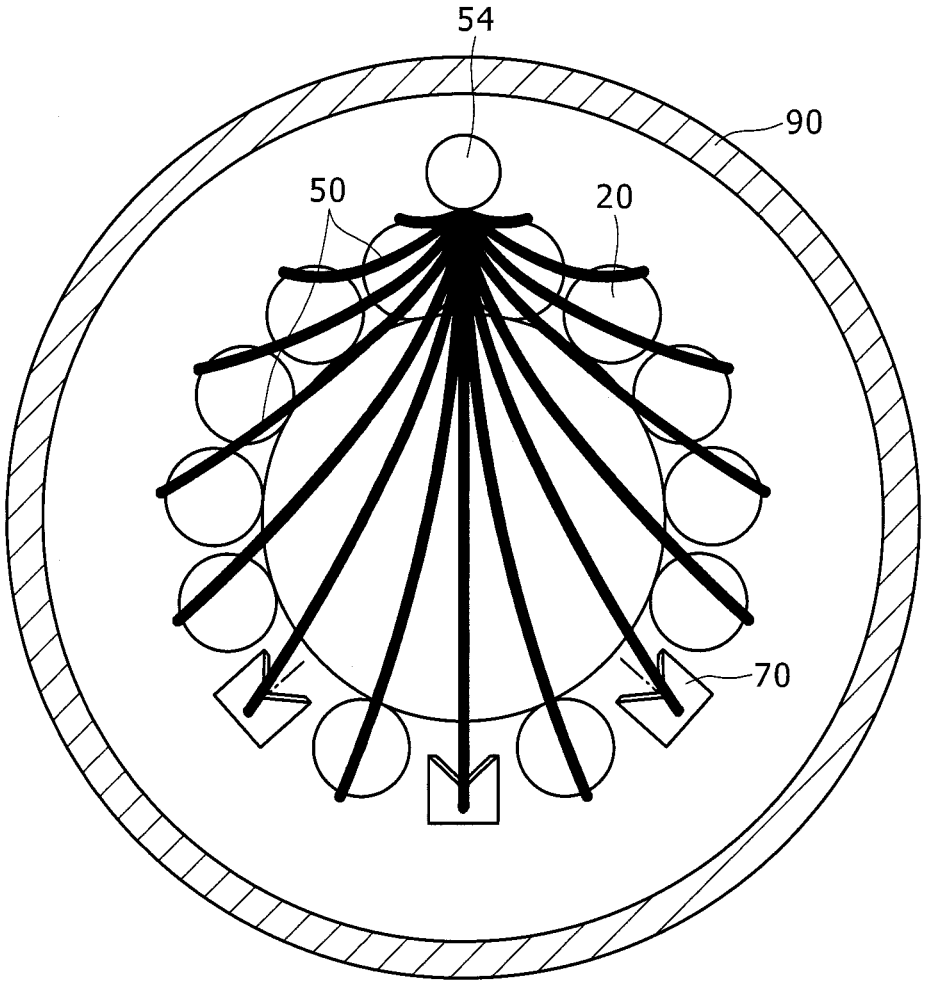
FIG. 6 A side view showing a condition in which detonating cords are routed to the treatment subject.

Next, the structure of a blast treatment device 1 used in the blast treatment method according to this embodiment will be described. FIG. 3 is a longitudinal section view schematically showing the blast treatment device 1 corresponding to Example 1, which will be described further below. FIGS. 4 and 5 show a section view taken along a line IV-IV in FIG. 3.

The blast treatment device 1 includes a shaped charge 70, a plurality of blasting explosive elements 20*a*, a plurality of cord-like explosive elements 30, a plurality of detonating cords 50, an electric detonator (a detonating device) 54, and a chamber 90.

The blasting explosive element 20*a* is composed of a blasting explosive 20 that is formed in a shape extending along a predetermined direction. The blasting explosive 20 is detonated to thereby blast the chemical ammunition 10. For example, the blasting explosive element 20*a* is shaped by pouring the blasting explosive 20 thereinto, which is flowable, into a bag element extending along the predetermined direction. In this embodiment, each blasting explosive element 20*a* has a cylindrical shape extending in the predetermined direction.

The blasting explosive elements 20*a*, i.e. the blasting explosives 20 contained in the blasting explosive element 20*a* are placed at a blasting explosive placement step, which will be described below, in a condition where they are spaced apart from each other along a circumferential direction on the outer circumferential surface of the outer container 60. At this step, the blasting explosive elements 20*a*, i.e. the blasting explosives 20 are arranged in orientations extending along a direction parallel to the central axis C2 of the outer container 60. The blasting explosives 20 are detonated on the outer circumferential surface of the outer container 60 at a blast step, which will be described below. The detonation energy of the blasting explosives 20 is exerted on the chemical ammunition 10 from surrounding areas of the chemical ammunition 10.

The detonation energy causes the chemical ammunition 10 to blast together with the outer container 60 and the inner container 40.

A detonation velocity of the blasting explosive 20 is smaller than that of a below-described initiating explosive 34. The blasting explosive 20 may be of any type having the detonation velocity smaller than that of the initiating explosive 34. It is however preferable that an explosive capable of flowing like powder or fluid, such as a slurry explosive or an emulsion explosive, for example, is used for the blasting explosive 20. The emulsion explosive or the slurry explosive has a detonation velocity of approximately 5 km/s. The emulsion explosive is relatively inexpensive and yet superior in performance. For this reason, when the emulsion explosive is used, the entire cost of the blast processing will be reduced.

Figure 9:
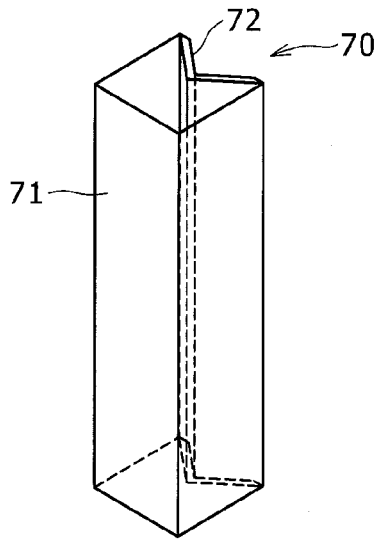
FIG. 9 A perspective view of the shaped charge used for the blast treatment device according to the embodiment of this invention.

The shaped explosive 70 breaks the outer container 60, the inner container 40, and the shell 11, and exposes an interior side of the shell 11. The shaped explosive 70 includes, as shown in FIG. 9, a metallic liner (metallic plate) 72 and an explosive 71. The metallic liner 72 has a substantially V-shaped cross section and extends along a specific direction. The explosive 71 is disposed on a projecting side of the metallic liner 72 along a surface of the projecting side of the metallic liner 72. The metallic liner 72 is composed, for example, of copper or the like. The explosive 71 is composed, for example, of Composition B or the like. Upon detonation of the explosive 71, the detonation energy of the explosive 71 causes the metallic liners 72 to crash each other and form a high-speed metal jet forward of the metallic liner 72.

Each of the shaped explosives 70 is placed at the below-described blasting explosive placement step on the outer circumferential surface of the outer container 60 in a state where they are spaced apart from each other in the circumferential direction. Then, the shaped explosive 70 is arranged to extend along the direction parallel to the central axis C2 of the outer container 60 in an orientation where a metallic liner 72 side of the shaped explosive 70 is faced toward the outer container 60. Each of the shaped explosives 70 is detonated on the outer circumferential surface of the outer container 60 to thereby generate the metal jet at the below-described blast step. The metal jet breaks the inner container 40, the outer container 60, and the shell 11.

Figure 8:
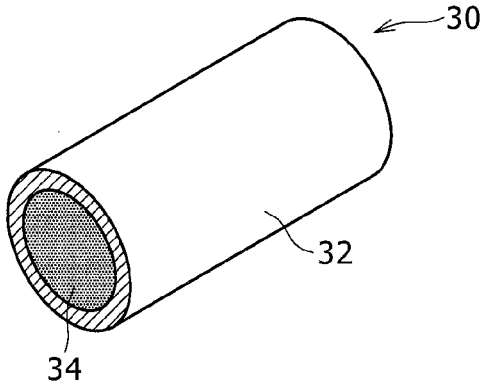
FIG. 8 A section view of a cord-like explosive element used for the blast treatment device according to an embodiment of this invention.

Each cord-like explosive element 30 detonates each blasting explosive 20. Specifically, the cord-like explosive element 30 includes the initiating explosive 34 to generate detonation energy capable of initiating each blasting explosive 20. The cord-like explosive element 30 is, as shown in FIG. 8, for example, composed of a string shaped explosive element that includes the initiating explosive 34 and an external cylinder 32. The external cylinder 32 is formed of plastic or other materials extending along a single direction. The initiating explosive 34 is stored within the external cylinder 32 and formed of PETN. The initiating explosive 34 has a detonation velocity of approximately 6 km/s, which is sufficiently greater than the detonation velocity of the emulsion explosive used as the blasting explosive 20.

The detonating cords 50 are detonated to respectively trigger detonation of the cord-like explosive elements 30 (the initiating explosives 34 respectively contained in the cord-like explosive elements 30) and the shaped explosives 70. More specifically, the detonating cord 50 includes an explosive to generate detonation energy capable of initiating one of the cord-like explosive elements 30 and one of the shaped explosives 70. In this embodiment, the detonating cord 50 is implemented by an element similar to the cord-like explosive element 30, i.e. the string shaped explosive element including the external cylinder 32 and the initiating explosive 34, which is stored within the external cylinder 32 and formed of PETN.

The electric detonator 54 causes each of the detonating cords 50 (the initiating explosive 34 contained in each detonating cord 50) to detonate, thereby initiating detonation of the detonating cords 50. The detonation energy of each of the detonating cords 50 detonates one of the shaped explosives 70 and the cord-like explosive elements 30. In turn, the detonation energy of each cord-like explosive element 30 detonates each blasting explosive 20. In this embodiment, the single electric detonator 54 is used to detonate the plurality of detonating cords 50.

The chemical ammunition 10 is totally blasted along with the outer container 60 and the inner container 40 inside the chamber 90. The chamber 90 includes a chamber main body **90*b* that is open to outside and a chamber lid 90*a* for openably and closably covering the opening of the chamber main body 90*b*. When the chamber lid 90*a* is closed, the inside of the chamber 90 is sealed off. The chamber 90 is an explosion proof structure composed of steel and other materials. In other words, the chamber 90 is of robust structure adapted to resist an explosion pressure developed upon a blast of the chemical ammunition 10** and to prevent hazardous or other substances emerging upon the blast in a sealed state from leaking to the outside.

In this embodiment, the outer container 60 accommodating therein both the chemical ammunition 10 and the inner container 40 is installed at an installation step, which will be described below, within the chamber 90 in the horizontally oriented condition (in the orientation where each of the central axes C1 and C2 of the chemical ammunition 10, the inner container 40, and the outer container 60 extends along the horizontal direction), and blasted while remaining in the same condition.

Here, as described above, each of the blasting explosives 20 is disposed on the outer circumferential surface of the outer container 60. For this reason, the distances from each of the blasting explosives 20 to the central axis C2 of the outer container 60 are equal to each other.

Consequently, as long as the central axis C2 of the outer container 60 is collinear with the central axis C1 of the chemical ammunition 10, distances from each of the blasting explosives 20 to the outer circumferential surface of the chemical ammunition 10 are also equal to each other. In this case, detonation energy of the plurality of blasting explosives 20 is uniformly transferred to the chemical ammunition 10 from its surrounding areas simply by detonating each of the blasting explosives 20 at the same time. In this way, the chemical ammunition 10 is treated efficiently.

However, there may be a case where the central axis C2 of the outer container 60 is not collinear with the central axis C1 of the chemical ammunition 10, i.e. the central axes C1 and C2 may be, in some cases, displaced from each other in a direction perpendicular to the central axes C1 and C2. In this case, each of the blasting explosives 20 is at a different distance from the outer circumferential surface of the chemical ammunition 10. Thus, in the above-described case, it is not possible to uniformly transfer the detonation energy of the plurality of blasting explosives 20 to the chemical ammunition 10 merely by detonating each of the blasting explosives 20 at the same time.

For example, in the presence of air between the outer container 60 and the inner container 40 as in the case of the example shown in FIG. 1 and other drawings, even though each of the central axes C1 and C2 of the outer container 60 and the chemical ammunition 10 lies on the same straight line in the vertically oriented condition, the central axes C1 and C2 will be mutually displaced when the outer container 60 is installed within the chamber 90 in the horizontally oriented condition as shown in FIG. 3 and other drawings. In particular, when the outer container 60 is brought into the horizontally oriented condition, the chemical ammunition 10 and the inner container 40 move down under their own weights. This causes the central axis C1 of the chemical ammunition 10 to be downwardly displaced from the central axis C2 of the outer container 60. Further, in another case, the chemical ammunition 10 may be previously stored in the outer container 60 with the central axis C1 of the chemical ammunition 10 displaced from the central axis C2 of the outer container 60.

The blast treatment method of this embodiment is a method for efficiently treating the chemical ammunition 10 in a case where the central axis C1 of the chemical ammunition 10 is thus displaced from the central axis C2 of the outer container 60 in the direction perpendicular to the central axes C1 and C2 as described above. It should be noted that the description is provided herein based on an instance where the undeformable cushioning material 42 is filled between the inner container 40 and the chemical ammunition 10 as described above, so that the chemical ammunition 10 is maintained coaxial with the inner container 40 irrespective of its orientation (vertically or horizontally oriented condition).

The blast treatment method in this embodiment includes the steps described below.

1) X-ray Observation Step

At this step, X-rays are used to observe a cross section of the outer container 60 in which the chemical ammunition 10 and the inner container 40 are housed.

In this step, the outer container 60 housing the chemical ammunition 10 and other components is firstly placed in the horizontally orientated condition. Then, X-rays are irradiated onto the outer container 60 to take a cross sectional image of an interior of the outer container 60 (an image on a plane perpendicular to the central axis C2 of the outer container 60), which is in the horizontally oriented position.

2) Explosive Position Determination Step

At this step, the placement of the blasting explosives 20 and the shaped explosives 70 is determined based on the X-ray cross sectional image of the interior of the outer container 60.

In this step, the placement of the explosives are determined in such a manner that each of both the shaped explosives 70 and the blasting explosives 20 is arranged at equal spacings in the circumferential direction on the outer circumferential surface of the outer container 60, and the shaped explosives 70 are positioned closer to the central axis C1 of the chemical ammunition 10 than to the central axis C2 of the outer container 60. In this embodiment, one of the shaped explosives 70 is placed on a location closest to the chemical ammunition 10 when the placement of the explosives 20, 70 is determined.

For example, in Example 1 employing twelve blasting explosives 20 and three shaped explosives 70, positions P1 to P15 are obtained as shown in FIG. 4 by equally dividing the outer circumferential surface of the outer container 60 into fifteen positions along the circumferential direction, and respectively defined as placement positions for each of the explosives 20 and 70. Then, the position P8 corresponding to a lower end part of the outer container 60 is determined as the placement position for one of the shaped explosive 70. Further, the positions P6 and P10 next but one to the position P8 are determined as the placement positions for the remaining two shaped explosives 70. Still further, all the remaining positions P1~P5, P7, P9, and P11~P15 are determined as the placement positions for the blasting explosives 20. In Example 1, as shown in FIG. 4, the central axis C1 of both the inner container 40 and the chemical ammunition 10 is located lower than the central axis C2 of the outer container 60 in the vertical direction while extending parallel to the central axis C2. Further, in Example 1, a vertical lower end part of the flange 62 is in contact with a vertical lower end part of the inner circumferential surface of the outer container 60 as shown in FIG. 3.

Alternatively, in the X-ray observation step, the cross section of the outer container 60 may be photographed in the vertically oriented position. In this case, the cross section of the outer container 60 in the orientation (the horizontally oriented position in this embodiment) to be established when it is blast-treated is estimated based on a filling material, a storage material, and other materials existing inside the outer container 60. Then, based on the estimated cross section, the placement of the blasting explosives and the shaped explosives 70 is determined at the explosive position determination step.

3) Blasting Explosive Detonation Timing Setting Step

At this step, a detonation timing is specified for each of the blasting explosives 20.

In this step, the detonation timing is established for each blasting explosive 20 in terms of the detonation energy of the blasting explosive 20, which is uniformly supplied to the inner container 40 and thus the chemical ammunition 10 from surrounding areas thereof on each cross section orthogonal to the central axis C2 of the outer container 60. Here, in connection with each blasting explosive 20 that is placed on the placement position determined at the explosive position determination step, a length of time for detonation energy of the blasting explosive 20 to arrive at the inner container 40 is calculated. Then, based on the length of time, the detonation timing is set for each of the blasting explosives 20.

Figure 10:
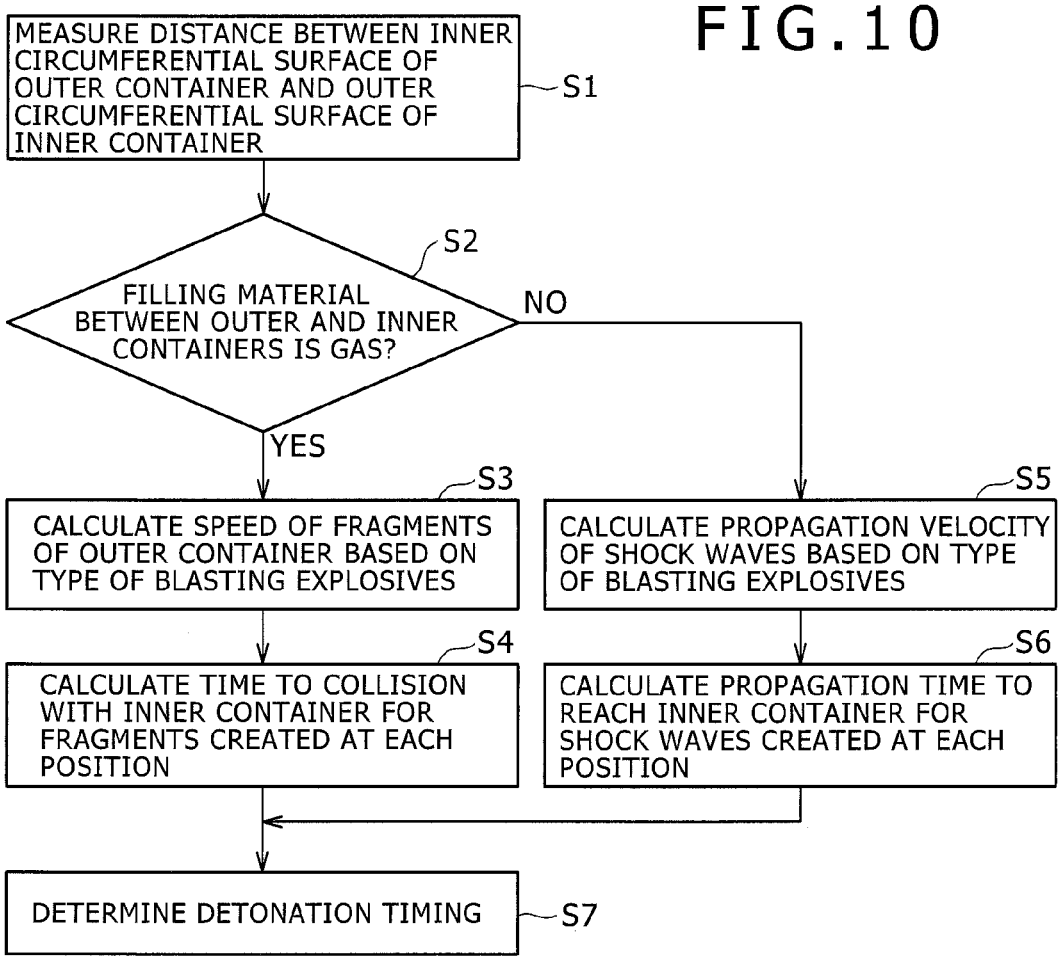
FIG. 10 A flowchart showing procedural steps to set a detonation timing for a blasting explosive element, and FIG. 11 A cross section view showing a condition in which each explosive is disposed on a treatment subject according to Example 2.

Procedural steps of setting the detonation timing will be explained with respect to a flowchart of FIG. 10.

Firstly, a distance travelled from each blasting explosive 20 to the inner container 40 by the detonation energy of the blasting explosive 20 is calculated. Specifically, at step S1, the distances from each of the blasting explosives 20 placed on the positions determined in the explosive position determination step to the inner container 40 are measured from the X-ray cross sectional image of the outer container 60. In this embodiment, for the purpose of precisely calculating the detonation timing, the distance is measured between the inner circumferential surface of the outer container 60 and the outer circumferential surface of the inner container 40 at each placement position of the blasting explosives 20. More specifically, on a line drawn by connecting the central axis C2 of the outer container 60 to each position at which each blasting explosive 20 makes contact with the outer circumferential surface of the outer container 60 when the blasting explosive 20 is placed on its placement position, the distance is measured as the length of a portion of the line between the inner circumferential surface of the outer container 60 and the outer circumferential surface of the inner container 40. Hereinafter, the length of the portion between the inner circumferential surface of the outer container 60 and the outer circumferential surface of the inner container 40 on the line connecting the specific position on the outer circumferential surface of the outer container 60 to the central axis C2 of the outer container 60 may be simply referred to as a separation distance between the outer container 60 and the inner container 40.

In the case of Example 1, measurements are respectively conducted to obtain separation distances between positions on the internal circumferential surface of the outer container 60, which are respectively opposed to the placement positions P1~P5, P7, P9, and P11~P15 of the blasting explosives, and the outer circumferential surface of the inner container 40.

Specifically, the distances indicated by reference characters from d1 to d5 and d7 in FIG. 5 are measured. Here, in Example 1, the positions are symmetrical between the positions P1~P5, P7 and the positions P9, P11~P15 (symmetrical between left and right in FIG. 5) about a vertical plane passing through the central axes C1 and C2 of the inner container 40 and the outer container 60

With this in view, only the distances d1 to d5 and d7 corresponding to the positions P1 to P5 and P7 are measured.

Next, at steps S2 to S6, based on both the separation distance between the outer container 60 and inner container 40 at the placement position of each blasting explosive 20 and a propagation velocity of detonation energy of the blasting explosive 20, calculation is performed to find a length of time for the detonation energy of each blasting explosive 20 to arrive at the inner container 40.

Here, upon detonation of the blasting explosive 20, the outer container 60 is broken into fragments. When the filling material filled between the outer container 60 and the inner container 40 is a gas, the fragments of the outer container 60 are dispersed flying toward the inner container 40 and the chemical ammunition 10 and directed to collide against them. In this way, the detonation energy of the blasting explosives is transferred to the inner container 40 and the chemical ammunition 10 from the fragments of the outer container 60.

On the other hand, when the filling material is a liquid or a solid, the fragments of the outer container 60 are not dispersed. Only shock waves created by detonation of the blasting explosives 20 propagate through the filling material and collide against the inner container 40 and the chemical ammunition 10. Or, the shock waves collide against the inner container 40 and the chemical ammunition 10 before the fragments of the outer container do. The detonation energy of the blasting explosive 20 is transferred to the inner container 40 and the chemical ammunition 10 only by propagation of the shock waves.

Then, it is firstly determined at step S2 whether or not the filling material filled between the outer container 60 and the inner container 40 is a gas. This determination is made based on the X-ray cross sectional image of the interior of the outer container 60, a work record, and others.

When the filling material is determined to be the gas at step S2, operation moves to step S3. At step S3, based on a type of the blasting explosive and the thickness of the outer container 60, a traveling (flying) speed of the fragments of the outer container 60 created by detonation of the blasting explosives is found. For example, the traveling speed of the fragments may be previously measured or calculated in association with the thickness of the outer container 60 and the type of the blasting explosives 20 through an experiment, a numerical analysis, or other means, and the thus measured or calculated value may be used. When the blasting explosives 20 are the emulsion explosives while the thickness of the outer container 60 is 3.4 mm, for example, the traveling speed of the fragments of the outer container 60 is approximately 2 km/s.

Subsequent to step S3, operation moves to step S4. At step S4, based on the traveling speed of the fragments of the outer container 60 and the separation distance between the outer container 60 and the inner container 40 at the placement position of each blasting explosive 20, a time to collision from detonation of each blasting explosive 20 until the fragments of the outer container 60 created at the placement position of the blasting explosive 20 collide against the outer circumferential surface of the inner container 40 is calculated for each of the blasting explosives 20. The time to collision is calculated for each of the blasting explosives 20 as "time to collision"="separation distance between inner circumferential surface of outer container 60 and outer circumferential surface of inner container 40 at placement position of blasting explosive 20"/"traveling speed of fragments". Following step S4, operation moves to step S7.

On the other hand, when the filling material is determined to be the liquid or solid at step S2, operation moves to step S5. At step S5, based on the type of the blasting explosives 20, the thickness of the outer container 60, and the type of the filling material, calculation is performed to find the propagation velocity at which the shock waves created by detonation of the blasting explosives 20 propagate through the filling material. For example, the propagation velocity of the shock waves is previously measured or calculated in association with the thickness of the outer container 60, the type of the blasting explosives 20, and the type of the filling material through an experiment, a numerical analysis, or other means, and the thus measured or calculated value is used. When the blasting explosives 20 are the emulsion explosives, the thickness of the outer container 60 is 3.4 mm, and the filling material is water, for example, the propagation velocity of the shock waves is approximately 5 km/s.

Following step S5, operation moves to step S6. At Step S6, based on the propagation velocity of the shock waves and the separation distance between the outer container 60 and the inner container 40 at the placement position of each blasting explosive 20, a time to collision from detonation of each blasting explosive 20 until the shock waves created at the placement position of the blasting explosive 20 collide against the outer circumferential surface of the inner container 40 is calculated for each of the blasting explosives 20. The time to collision is calculated for each of the blasting explosives 20 as "time to collision"="separation distance between inner circumferential surface of outer container 60 and outer circumferential surface of inner container 40 at placement position of blasting explosive 20"/"propagation velocity of shock waves". Following step S6, operation moves to step S7.

At step S7, based on the time to collision required for the fragments of the outer container 60 or the shock waves to collide against the outer circumferential surface of the inner container 40, which is calculated for each blasting explosive 20, the detonation timing is set for each of the blasting explosives 20. At step S7, the detonation timing of each blasting explosive 20 is specified in such a manner that the difference in the detonation timing of each blasting explosive 20 substantially agrees with the difference in the time to collision calculated for the blasting explosive 20. Specifically, the detonation timing of a blasting explosive 20 with respect for which the longest time to collision is calculated is defined as a reference time t0. Further, calculation is performed to respectively find differences tx between the time to collision obtained for the remaining blasting explosives 20 and the longest time to collision. Then, the detonation timing for each of the remaining blasting explosives 20 is set to a time obtained by a summation of the reference time t0 and each of the differences tx in the time to collision.

Here, after step S7, it is preferable to check whether or not the detonation timings established in step S7 are appropriate. For example, the checking is performed using a previously formulated numerical simulation capable of computing pressures around the inner container 40 and the chemical ammunition 10 resulting from detonation of the blasting explosives 20. In particular, the numerical simulation is used to calculate the pressures obtained around the inner container 40 and the chemical ammunition 10 at each clock time by detonating each blasting explosive 20 at the detonation timing calculated in step S7. Then, it is verified that the pressures around the inner container 40 and the chemical ammunition 10 at each clock time are uniform in the circumferential direction. When the pressures are uniform, the established detonation timing is identified as being appropriate. On the other hand, when the pressures are not uniform, the detonation timing calculated in step S7 is preferably corrected based on the result of the numerical simulation.

4) Shaped Explosive Detonation Timing Setting Step

At this step, a detonation timing is set for each of the shaped explosives 70.

In this step, all the detonation timings of the plurality of shaped explosives 70 are determined to be earlier than the detonation timings of the blasting explosives 20 adjacent to the shaped explosives 70, respectively. In addition, all of the detonation timings of the shaped explosives 70 are set to a timing at which the detonation energy of the blasting explosive 20 does not adversely affect generation and strength of the metal jet created by each shaped explosive 70.

5) Explosive Placement Step 5-1) Shaped Explosive Placement Step

At this step, each of the shaped explosives 70 is placed and fixed at the position on the outer circumferential surface of the outer container 60 determined in the explosive position determination step. Then, each shaped explosive 20 is placed in an orientation extending along a direction parallel to the central axis C2 of the outer container 60.

In the example shown in FIG. 4, the shaped explosives 70 are respectively fixed to the positions P6, P8, and P10. At this time, a region of each shaped explosive 70 on a metallic liner 72 side faces toward the outer container 60. Further, an apex of a letter V of the metallic liner 72 is separated from the outer container 60 by a given amount. The metal jet is concentrated, in particular, on locations separated from the metallic liner 72 by the given amount. Because of this, the metal jet is effectively directed to the outer container 60 when the metallic liner 72 is spaced away from the outer container 60 as described above.

5-2) Blasting Explosive Placement Step

At this step, each of the blasting explosives 20 is placed and fixed at the position on the outer circumferential surface of the outer container 60 determined in the explosive position determination step. At this time, each blasting explosive 20 is placed in the orientation extending in the direction parallel to the central axis C2 of the outer container 60.

In the example shown in FIG. 4 and other diagrams, the blasting explosives 20 are respectively fixed to the positions P1 to P5, P7, P9, and P11 to P15.

Here, in the example shown in FIG. 3, the blasting explosives 20 and the shaped explosives 70 are arranged only on a portion of the outer circumferential surface of the outer container 60 where the inner container 40 is surrounded by the outer container 60. Alternatively, the blasting explosives 20 and the shaped explosives 70 may be arranged across the entire axial length of the outer container 60. Further, the blasting explosive placement step may be performed before the shaped explosive placement step.

5-3) Cord-Like Explosive Element Placement Step

At this step, each of the cord-like explosive elements 30 is routed to each outer circumferential surface of the blasting explosives 20 (blasting explosive elements 20*a*).

In this step, each cord-like explosive element 30 is routed to a region opposite to the outer container 60 on the outer circumferential surface of the blasting explosive 20. At this time, the cord-like blasting element 30 is arranged parallel to the central axis C2 of the outer container 60. In this embodiment, each of the cord-like blasting elements 30 is arranged across the entire longitudinal length of each blasting explosive 20.

5-4) Detonating Cord Placement Step

At this step, the detonating cords 50 are respectively connected to the cord-like blasting elements 30 and the shaped explosives 70.

In this step, an elongated detonating cord in a shape of a string having been prepared in advance is cut into a plurality of detonating cords 50. Then, a differential length of each detonating cord 50 is matched to a value obtained by multiplying the difference in detonation timing of each shaped explosive 70 and in target detonation timing of each cord-like explosive element 30, having been established in the detonation timing setting step, by a detonation velocity of the initiating explosive 34 (PETN) contained in the detonation cord 50. Note that the blasting explosive 20 is detonated immediately after detonation of the corresponding cord-like explosive element 30. Accordingly, the target detonation timing of each cord-like explosive element 30 is identical to the detonation timing of each blasting explosive 20 established in the detonation timing setting step. Then, one ends of the detonating cords 50 are respectively connected to longitudinal ends of the cord-like explosive elements 30 routed to the blasting explosives 20 and longitudinal ends of the shaped explosives 70. Here, the explosive (explosive element), which is to be detonated at an earlier detonation timing, is connected to a shorter detonating cord 50. Then, all the other ends of the detonating cords 50 are bundled together and connected to the common electric detonator 54.

Here, the detonating cords 50 and the cord-like explosive elements 30 are explosive elements of the same structure. In this regard, both the cord-like blasting element 30 routed to each blasting explosive 20 and the detonating cord 50 connected to each cord-like explosive element 30 may be composed of the single detonating cord 50 (the cord-like explosive element 30).

6) Installation Step

At this step, the outer container 60, which houses therein the chemical ammunition 10 and the inner container 40, is installed in the chamber 90.

In this step, as shown in FIG. 3, the outer container 60 is suspended inside the chamber 90 in a state where the shaped explosives 70, the blasting explosives 20, and the cord-like explosive elements 30 are fixed to the outer container 60 around its periphery. Here, the suspended outer container 60 is arranged in the horizontally oriented condition with the central axis C2 extending along the horizontal direction. In this embodiment, the outer container 60 is placed in a central area of the chamber.

The installation step may be carried out before the blasting explosive placement step or the shaped explosive placement step. In other words, the shaped explosive placement step and the blasting explosive placement step may be carried out while the outer container 60 is housed within the chamber 90.

7) Blast Step

At this step, the outer container 60 and the inner container 40 are broken by the shaped explosives 70 to thereby expose the chemical ammunition 10, and the exposed chemical ammunition 10 is blast-treated by the detonation energy of the blasting explosives 20.

Specifically, a firming cable 56 extended from the electric detonator 54 is firstly connected to a not-illustrated firming device.

Next, the firming device is operated to simultaneously detonate all the initiating explosives 34 respectively contained in the detonating cords 50 by means of the electric detonator 54.

As described above, the differential length of each detonating cord 50 matches the multiplication product of the difference in detonation timing of each initiating explosive 30 and of each shaped explosive 70 and the detonation velocity of the initiating explosive 34 in the detonating cord 50. As a result, the detonation energy of the initiating explosives 34 in the detonating cords 50 respectively propagate to the cord-like explosive elements 30 and the shaped explosives 70 with time lags shifted by the differences in detonation timing. In response to the time lags, the cord-like explosive elements 30 and the shaped explosives 70 are respectively detonated at the timings shifted by the difference in detonation timing established for each of the cord-like explosive elements 30 and shaped explosives 70.

Once the cord-like explosive elements 30 start detonating, the corresponding blasting explosives 20 are blasted upon receipt of detonation energy from the cord-like explosive elements 30. The detonation timings of the cord-like explosive elements 30 are substantially simultaneous with those of the blasting explosives 20, while the blasting explosives 20 are respectively detonated at the detonation timings established in the detonation timing setting step. The detonation of each cord-like explosive element 30 propagates from its one end on an electric detonator 54 side to the other end in a direction parallel to the central axis C2 of the outer container 60. In response to this, each blasting explosive 20 is blasted along the direction parallel to the central axis C2 of the outer container 60.

The detonation energy of each blasting explosive 20 destroys the outer container 60 into fragments. Or, the detonation energy of each blasting explosive 20 generates shock waves. The fragments of the outer container 60 or the shock waves fly or propagate toward the inner container 40, and collide against the outer circumferential surface of the inner container 40. The collision brings surrounding areas of the inner container 40 into an ultrahigh pressure state, thereby generating shock waves in the surrounding areas. In addition, the collision also destroys the inner container 40, thereby creating the fragments of the inner container 40. The fragments of the outer container 60 or the shock wave transferred from the outer container 60 side in addition to both shock waves generated around the inner container 40 and fragments of the inner container 40 collide against the outer circumferential surface of the chemical ammunition 10. The collision creates the ultrahigh pressure state around the shell 11. As a result, the bursting charge 13 contained in the chemical ammunition 10 is exploded, while the chemical agent 12 is decomposed under the ultrahigh pressure.

The difference in detonation timing of each blasting explosive 20 almost match the difference in time to collision from generation of the fragments of the outer container 60 or the shock waves created in the vicinity of each blasting explosive 20 until the fragments or the shock waves collide against the outer circumferential surface of the inner container 40. This allows the fragments of the outer container 60 or the shock waves, i.e. the detonation energy of each blasting explosive 20 to simultaneously collide against the inner container 40 and the chemical ammunition 10 from their surrounding areas even though the fragments of the outer container 60 or the shock waves are respectively created at different timings in the vicinity of each blasting explosive 20. In this way, the detonation energy of a plurality of the blasting explosives 20 are gathered on the inner container 40 and the chemical ammunition 10. Consequently, the entire surrounding areas of the inner container 40 and the chemical ammunition 10 are brought into the ultrahigh pressure state, so that the chemical agent 12 is exposed to the ultrahigh pressure field, and accordingly decomposed efficiently.

The cord-like explosive element 30 for detonating each blasting explosive 20 is routed to the outer circumferential surface of the blasting explosive 20 on its surface opposite to the outer container 60. For this reason, at the time of detonation of the blasting explosives 20, the ultrahigh pressure and ultrahigh temperature field generated by the detonation of the initiating explosive 34 is present on a side of the blasting explosive 20 opposite to the outer container 60. Consequently, the detonation energy of each blasting explosive 20 is directed toward the outer container 60. In this way, the detonation energy of each blasting explosive 20, i.e. the fragments of the outer container 60 or the shock waves are effectively transferred to the inner container 40.

Figure 7:
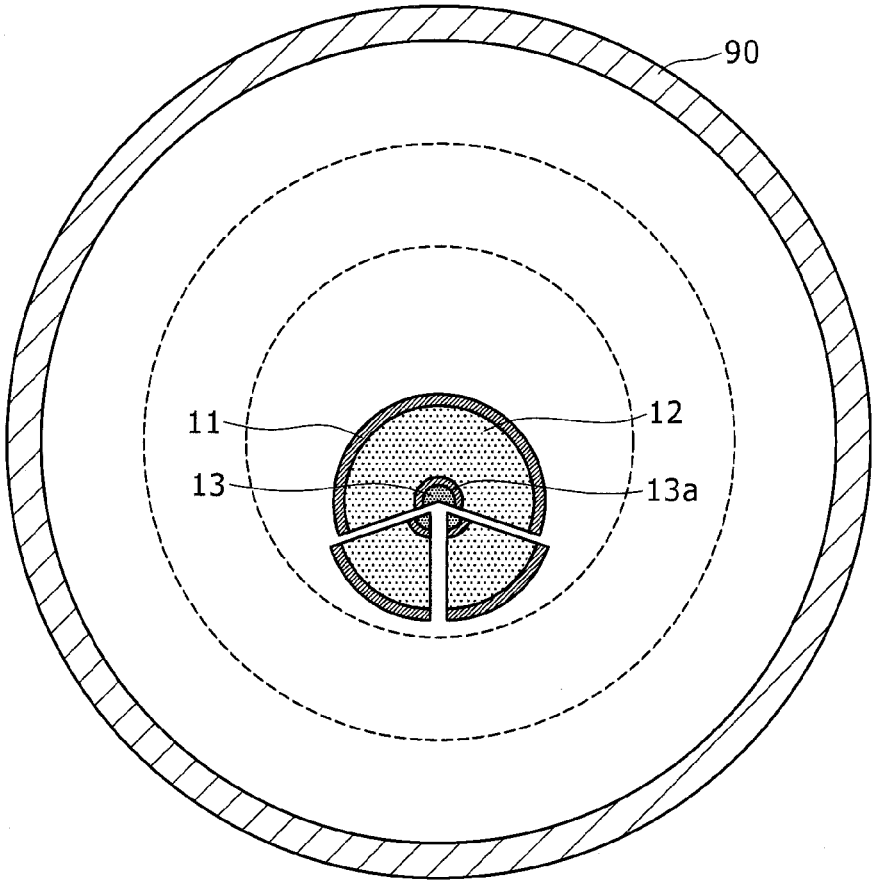
FIG. 7 A drawing for explaining an effect of a shaped charge.

Meanwhile, when the shaped explosives 70 are detonated, the metallic liners 72 of the shaped explosive 70 start crashing each other. The crashed metallic liner 72 creates high-speed metal jets. As shown in FIG. 7, the metal jets cut up the outer circumferential surfaces of the outer container 60, the inner container 40, and the shell 11. When the outer circumferential surfaces are cut, the chemical agent 12 within the chemical ammunition 10 is exposed. The thus-exposed chemical agent 12 is caused to react with a high-temperature detonation product gas generated by the detonation energy of the blasting explosives 20, and accordingly decomposed with efficiency.

Here, the detonation timing of the shaped explosive 70 is determined to be earlier than that of the adjacent blasting explosive 20 and approximately set to the timing at which the detonation energy of the blasting explosive has no adverse effect on generation and strength of the jets created by the shaped explosive 70. This prevents cutting sites of the outer container 60, the inner container 40, and the shell 11 intended to be cut by the metal jets from becoming deformed due to the detonation energy of the blasting explosive 20 before the intended cutting, and thus allows the metal jets to properly cut the outer container 60 and others.

In this way, the chemical ammunition 10, the chemical agent 12, and even the chemical agent 12 contaminating the inner and outer containers 40 and 60 are successively decomposed and rendered harmless with efficiency at this step.

As described above, in this blast treatment method, the fragments of the outer container 60 or the shock waves, which are respectively created at the different timings on a plurality of circumferential locations of the outer container 60, collide against the inner container 40 and thus the chemical ammunition 10 almost at the same time. As a result, while fragments of the shell 11 are prevented from flying outward, the detonation energy of each blasting explosive 20 effectively concentrate on the inner container 40. This ensures secure treatment of the inner container 40 and thus the chemical 10. In addition, the thus-concentrated detonation energy of each blasting explosive 20 brings the surrounding areas of the chemical agent 12 into the ultrahigh pressure state, which further ensures reliable decomposition of the chemical agent 12.

Here, the cord-like explosive elements 30 containing the initiating explosives 34 may be omitted. In this case, the electric detonator 54 may be connected to the blasting explosives 20 by means of the detonating cord 50. However, when the blasting explosives 34 having the greater detonation velocities are placed on the outside of the blasting explosives 20, and used for detonating the blasting explosives 20 as implemented in this embodiment, detonation vectors of the blasting explosives 20 can be directed inward. This prevents the fragments of the outer container 60, the fragments of the shell 11, and the chemical agent 12 from flying outside, to thereby minimize damage to the chamber 90. This, in turn, allows greater detonation energy to be exerted on the chemical ammunition 10 and the outer container 60, which further ensures that the chemical ammunition 10 and others are more securely rendered harmless.

Further, the specific structure of the initiating explosive 34 for detonating the blasting explosive 20 is not limited to the above-described structure in which the initiating explosive 34 is contained in the cord-like explosive element 30. For example, the initiating explosive 34 formed in a shape of a sheet may be wound around the outside of the blasting explosive 20 (the blasting explosive element 20*a*) in place of the cord-like blasting explosive element 30. Further, both the cord-like explosive element 30 and the explosive formed in the shape of the sheet may be arranged on the outside of the blasting explosive 20. In this regard, however, the use of the cord-like explosive element 30 containing the blasting explosive 34 and having the shape that extends along one direction can facilitate placement of the initiating explosive 34 on the periphery of the blasting explosive 20 in a simple way, such as by arranging the cord-like explosive element 30 on the outside of the blasting explosive 20. This enhances the efficiency in the blast treatment.

Still further, the shaped explosives 70 may be omitted. However, when the shaped explosives 70 are used to generate the metal jets whereby the outer container 60, the inner container 40, and the shell 11 are cut to expose the internal region of the shell 11, it is possible to accelerate the reaction between the chemical agent 12 and the high-temperature detonation product gas created by the detonation energy of the blasting explosive 20. Namely, the detonation energy of the blasting explosive 20 can be effectively transferred to the chemical agent 12 installed within the shell 11. This can ensure secure decomposition of the chemical agent 12.

Furthermore, the shaped explosives 70 may be placed at any position as long as they are located outside the outer container 60. However, the placement of the shaped explosives 70 at the positions closer to the inner container 40 can contribute to improved transfer of the metal jets to the inner container 40 and the shell 11.

Moreover, the detonation timing of the shaped explosive 70 may be set irrespective of the detonation timing of the adjacent blasting explosive 20. However, detonation of the adjacent blasting explosive 20 prior to the shaped explosive 70 may result in deformation of the shaped explosive 70 due to the detonation energy of that blasting explosive 20. The deformation has adverse effects on appropriate generation and strength of the metal jets. In addition, the detonation of the adjacent blasting explosive 20 prior to the shaped explosive 70 may also cause the inner container 40 and the shell 11 to become deformed by the detonation energy of that blasting explosive 20. Such deformation of the inner container 40 and other components interferes with an ability of the metal jets to appropriately cut up the inner container 40 and other components. For this reason, it is preferable that the detonation timing of the shaped explosive 70 is set to be earlier than that of the adjacent blasting explosive 20.

In addition, the specific form of the blasting explosive 20 (the blasting explosive element 20*a*) is not limited to the above-described cylindrical shape. For example, the blasting explosive 20 may be formed in the shape of a sheet. The position of each blasting explosive 20 may be any position located on the exterior surface of the outer container 60 as long as the blasting explosives 20 are spaced apart from each other in the direction surrounding the central axis C2 of the outer container 60 and arranged to extend substantially parallel to the central axis C2, and is not limited to any particular position. For example, in a case where the blasting explosive formed in the shape of a sheet is used, the blasting explosive in the shape of a single sheet may be placed on the exterior surface of the outer container 60 over the entire region where the same detonation timing is employed. In this case, a plurality of the detonating cords are respectively attached to different portions of the sheet-shaped blasting explosive, and the portions may be detonated at the same timing.

Further, the inner container 40 may be omitted. Namely, the blast treatment method according to this invention is also applicable in a case where the chemical ammunition 10 is directly housed in the outer container 60. In this case, based on both the separation distance between the inner circumferential surface of the outer container 60 and the outer circumferential surface of the shell 11 at each position of the blasting explosives 20 (the length of a portion between the inner circumferential surface of the outer container 60 and the outer circumferential surface of the shell 11 measured on each line connecting both the position at which each blasting explosive 20 contacts with the outer circumferential surface of the outer container 60 and the central axis C2 of the outer container 60) and based on the type of the filling material between the outer container 60 and the chemical ammunition 10, calculation may be performed to find the time to collision of the fragments of the outer container 60 or the shock waves.

Still further, the blast treatment method according to this invention is also applicable in a case where the shell 11 is not collinear with the inner container 40.

Furthermore, although it has been described in the above embodiment that the length of the detonating cord 50 is adjusted in accordance with the detonation timing of each blasting explosive 20, to thereby control the detonation timing of the blasting explosive 20, the control of the detonation timings of the blasting explosives 20 is not limited to the above described way. For example, all the detonating cords 50 may be of the same length and respectively connected to the individual electric detonators 54. Then, the blasting explosives 20 may be blasted at different detonation timings by changing the timing in which each of the electric detonators 54 detonates each of the detonating cords 50. However, when the detonation timings of the blasting explosives 20 are controlled by means of the lengths of the detonating cords 50 as in the case of the above described embodiment, the structure can be simplified with the smaller number of the electric detonators 54. In addition, time and effort to connect the plurality of detonating cords 50 and the electric detonators 54 can be reduced.

Moreover, in this embodiment, the position where the blasting explosive 20 is detonated at the established detonation timing is not limited to the longitudinal end of the blasting explosive 20. For example, the blasting explosive 20 may be detonated at its longitudinal center. In this case, for example, the detonating cord 50 is connected to the longitudinal center of the blasting explosive 20. Alternatively, a plurality of portions of each blasting explosive 20 may be respectively detonated at the established detonation timing. Further, when the distance between the blasting explosive 20 and the outer circumferential surface of the inner container 40 changes in the direction along the central axis C1 of the inner container 40, different detonation timings may be defined for the plurality of portions of the blasting explosive 20 in the direction along the central axis C1 of the inner container 40, to thereby independently detonate the plurality of portions. In this case, the detonation timings are respectively defined depending on the distances between each portion of the blasting explosive 20 and the outer circumferential surface of the inner container 40.

In addition, the way of setting the detonation timing of the blasting explosive 20 is not limited to that described above. Specifically, the detonation timing of the blasting explosive 20 may be any timing as long as the fragments of the outer container 60 or the shock waves respectively created in the vicinity of each blasting explosive 20 by the detonation energy of the blasting explosive 20 collide against the shell 11 with a temporal difference smaller than that caused by simultaneously detonating the plurality of blasting explosives 20.

Next, results of an experiment in which the blast treatment method is applied to the chemical ammunition 10 as described above will be described.

This experiment is carried out using an ammunition item 10 formed in the shape as shown in FIGS. 1 and 2, and filled with n-DBS (n-butyl sulfide) in place of the chemical agent 12. The ammunition item 10 is housed within the inner container 40 in a condition covered with a polyethylene sheet 42. The inner container 40 is housed within the outer container 60. The flanges 62 are mounted on the inner container 40. There exists air between the inner container 40 and the outer container 60.

In Example 1, the containers 40 and 60 have dimensions and other specifications described below. The outer container 60 is a steel container, which is 305 mm in diameter, 1,327 mm in length, and 3.4 mm in wall thickness. The inner container 40 is a container, which is 175 mm in diameter and 1.4 mm in wall thickness. The flange 62 mounted on the inner container 40 has a diameter of 216 mm. In Example 1, twelve blasting explosives 20 and three shaped explosives 70 were used.

In Example 2, the containers 40 and 60 have dimensions and other specifications described below. The outer container 60 is a steel container, which is 248 mm in diameter, 1,407 mm in length, and 3.4 mm in wall thickness. The inner container 40 is a container similar to that of Example 1, i.e. the container is 175 mm in diameter and 1.4 mm in wall thickness and equipped with the flanges 62 having the diameter of 216 mm on the outside of the container. In Example 2, ten blasting explosives 20 and three shaped explosives 70 were used.

Example 1

The experiment of Example 1 will be described.

Firstly, the outer container 60 housing the ammunition item 10 and the inner container 40 was placed in the horizontally oriented condition, and an X-ray image of a cross section of the outer container 60 was taken in the horizontally oriented condition.

The following fact was found by checking the X-ray cross section image inside the outer container 60. In Example 1, the central axis C1 of the inner container 40 and the chemical ammunition 10 was downwardly shifted from the central axis C2 of the outer container 60 along the vertical direction in the horizontally oriented condition of the outer container 60 as shown in FIGS. 3 and 4. Further, the central axis C1 was in parallel with the central axis C2. The lower ends of the flanges 62 attached to the inner container 40 were in contact with the lower end of the inner circumferential surface of the outer container 60.

Next, positions of the blasting explosives 20 and the shaped explosives 70 were determined. In example 1, the positions P6, P8, P10 shown in FIG. 4 were determined as the positions of the shaped explosives 70 as described above. Further, the positions P1 to P5, P7, P9, and P11 to P15 were determined as the positions of the blasting explosives 20.

Then, based on the X-ray cross section image, the separation distance between the outer container 60 and the inner container 40 was measured at each placement position of the blasting explosives 20. Based on the measured distances, calculation was performed to find the time to collision required for the detonation energy of each blasting explosive 20 (the fragments of the outer container 60 or the shock waves) to collide against the inner container 40. Specifically, the filling material between the outer container 60 and the inner container 40 was air. With this in view, the measured distances and the flying speed (2 km/s) at which the fragments of the outer container 60 travel through air were used to respectively calculate the times to collision. Further, the differences in the times to collision were also calculated.

Next, based on the differences in the times to collision, the detonation timing was determined for each of the blasting explosives 20. The detonation timings of the blasting explosives 20 at the positions P1 to P3 and P13 to P15 were defined as t0, while the detonation timings of the blasting explosives 20 at the positions P4, P5, P7, P9, P11, and P12 were defined as t0+20 μs. Further, the detonation timing of each shaped explosive 70 was defined as t0+10 μs, which is earlier than the detonation timing t0+20 μs of the adjacent blasting explosive 20.

Table 1 shows the separation differences between the outer container 60 and the inner container 40 at the placement positions of the blasting explosives 20, the times to collision associated with the blasting explosives 20, the differences in the times to collision, and the detonation timings. Table 1 shows, as the differences in the times to collision, values of the differences between the longest time to collision and other times to collision expressed relative to the earliest detonation timing that is taken as 0.

TABLE 1

| | Position of blasting explosive | | | | | |
|---|---|---|---|---|---|---|
| | P1, P15 | P2, P14 | P3, P13 | P4, P14 | P5, P11 | P7, P9 |
| Distance between outer and inner containers d [mm] | 102.6 | 98.3 | 90.6 | 75.8 | 57.5 | 25 |
| Time to collision [μs] | 51.3 | 49.2 | 45.3 | 37.9 | 28.8 | 12.5 |
| Difference in time to collision [μs] | 0.0 | 2.2 | 6.0 | 13.4 | 22.6 | 38.8 |
| Detonation timing [μs] | 0 | 0 | 0 | 10 | 20 | 20 |

Next, the detonating cords 50 whose lengths respectively correspond to the detonation timings were prepared. The blasting explosives 20 and the shaped explosives 70 were placed on the outer circumferential surface of the outer container 60. The cord-like explosive elements 30 were arranged to the blasting explosives 20. The detonating cords 50 were respectively connected to the cord-like explosive elements 30 and the shaped explosives 70. The outer container 60 on which the explosives and the explosive elements were placed was installed inside the chamber 90. Here, in Example 1, the blasting explosives 20 and the shaped explosives 70 were mounted only on a portion of the outer circumferential surface of the outer container 60 where the outer container 60 is opposed to the inner container 40. Next, the detonating cords 50 were connected to the electric detonator 54. Then, the electric detonator 54 was operated to detonate the detonating cords 50 and thus the blasting explosives 20 and others, thereby blasting the outer container 60 and other components.

The result of blasting the outer container 60 and other components with the blast treatment method as described above was that the portion of the outer circumference of the outer container 60 where the blasting explosives 20 and the shaped explosives 70 were placed, the inner container 40, and the shell 11 were destroyed and broken into small fragments. Further, both the bursting charge 13 and n-DBS were decomposed. In particular, the concentration of n-DBS contained in the detonation product gas and residues in the chamber 90 was measured, and it was confirmed that a decomposition rate was 99.99995%.

Here, in a modification of Example 1 wherein water exists between the outer container 60 and the inner container 40, for example, the times to collision associated with the blasting explosives 20, the differences in the times to collision, and the detonation timings are determined using the propagation velocity of the shock waves (5 km/s) and established as shown in Table 2.

TABLE 2

| | Position of blasting explosive | | | | | |
|---|---|---|---|---|---|---|
| | P1, P15 | P2, P14 | P3, P13 | P4, P14 | P5, P11 | P7, P9 |
| Time to collision [μs] | 20.5 | 19.7 | 18.1 | 15.2 | 11.5 | 5.0 |
| Difference in time to collision [μs] | 0.0 | 0.9 | 2.4 | 5.4 | 9.0 | 15.5 |
| Detonation timing [μs] | 0 | 0 | 0 | 7.5 | 15 | 15 |

Example 2

The experiment of Example 2 will be described.

Similarly with example 1, the outer container 60 is firstly placed in the horizontally oriented condition, and an X-ray image of the cross section of the outer container 60 was taken.

Figure 11:
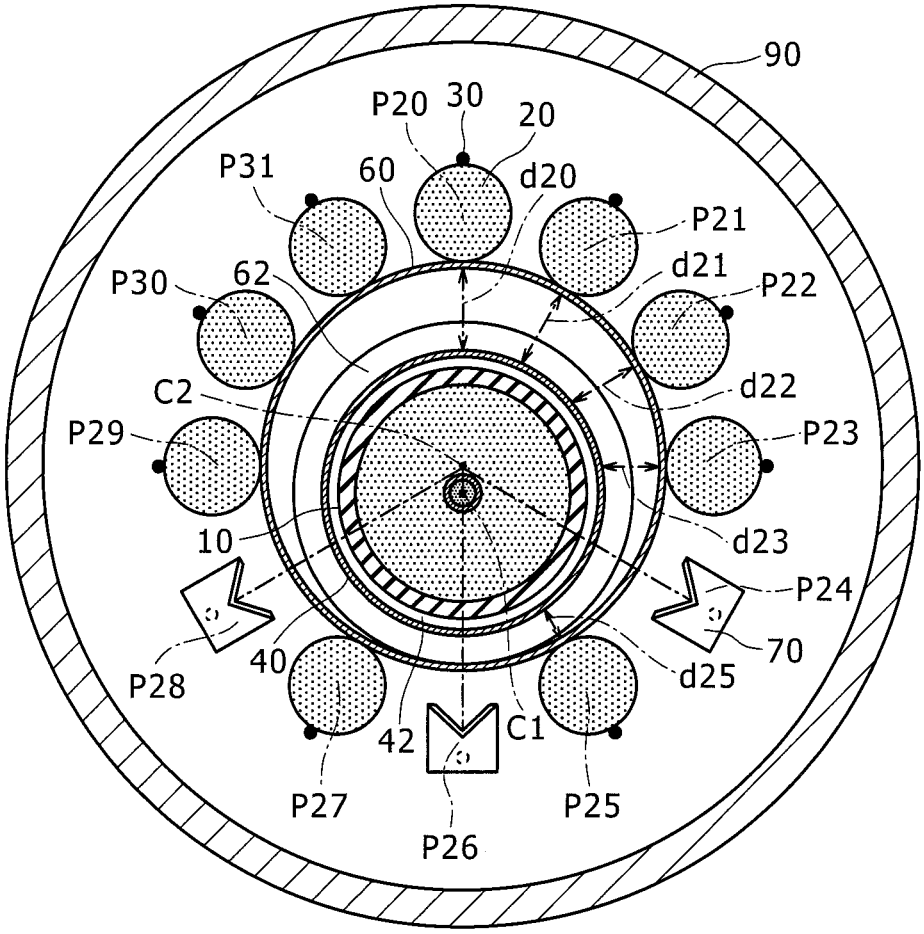

An inspection of the X-ray cross section image inside the outer container 60 revealed facts described below. In Example 2, the central axis C1 of the inner container 40 and the chemical ammunition 10 were downwardly shifted from the central axis C2 of the outer container 60 along the vertical direction in the horizontally oriented condition of the outer container 60 as shown in FIG. 11. Further, the central axis C1 and the central axis C2 were parallel to each other. The lower ends of the flanges 62 attached to the inner container 40 were in contact with the lower end of the inner circumferential surface of the outer container 60.

Next, positions of the blasting explosives 20 and the shaped explosives 70 were determined. In Example 2, the positions P24, P26, and P28 shown in FIG. 11 were defined as the placement positions of the shaped explosives 70. Meanwhile, positions P20 to P23, P25, P27, and P29 to P31 were defined as the placement positions of the blasting explosives 20. Then, the placement positions of the blasting explosives 20 were symmetrically arranged with respect to the vertical plane that passes through the central axis C1 (symmetrical between left and right in FIG. 11).

Next, based on the X-ray cross section image, the separation distances (d20, d21, d22, d23, d25) between the outer container 60 and the inner container 40 were measured at the placement positions of the blasting explosives 20. Note that the positions of the blasting explosives 20 are symmetrical about the vertical plane that passes through the central axis C1 as described above. For this reason, the separation distances between the outer container 60 and the inner container 40 were measured only at the placement positions P20 to P23, and P25 of the blasting explosives 20. Based on the measured distances, calculation was performed to find the time to collision required for the detonation energy of each blasting explosive 20 (the fragments of the outer container 60 or the shock waves) to collide against the inner container 40. Specifically, the filling material between the outer container 60 and the inner container 40 is air. Accordingly, also in Example 2, the measured distances and the flying speed of the fragments of the outer container 60 traveling through air were used to calculate the times to collision as in the case of Example 1. Further, the differences in the times to collision were calculated.

Next, based on the differences in the times to collision, the detonation timings were respectively determined for the blasting explosives 20. The detonation timings of the blasting explosives 20 at the positions P20 to P22, P30, and P31 were defined as t0 μs, while the detonation timings of the blasting explosives 20 at the positions P23, P25, P27, and P29 were defined as t0+14 μs. Further, the detonation timing of each shaped explosive 70 was defined as t0+7 μs, which is earlier than the detonation timing of the adjacent blasting explosive 20 (at the position P23, P25, P27, or P29).

Table 3 shows the separation distances between the outer container 60 and the inner container 40 at the placement positions of the blasting explosives 20, the times to collision associated with the blasting explosives 20, the differences in the times to collision, and the detonation timings.

TABLE 3

| | Position of blasting explosive | | | | |
|---|---|---|---|---|---|
| | P20 | P21, P31 | P22, P30 | P23, P29 | P25, P27 |
| Distance between outer and inner containers d [mm] | 47.7 | 45.5 | 40.5 | 34.8 | 22.4 |
| Time to collision [μs] | 23.9 | 22.8 | 20.3 | 17.4 | 11.2 |
| Difference in time to collision [μs] | 0 | 1.1 | 3.6 | 6.5 | 12.7 |
| Detonation timing [μs] | 0 | 0 | 0 | 14 | 14 |

Next, the detonating cords 50 whose lengths respectively correspond to the detonation timings were prepared. The blasting explosives 20, the shaped explosives 70, the cord-like explosive elements 30, and the detonating cords 50 were respectively arranged at their predetermined positions. Also in Example 2, the blasting explosives 20 and the shaped explosives 70 were placed only on the portion of the outer circumferential surface of the outer container 60 where the outer container 60 is opposed to the inner container 40 as in the case of Example 1. Then, the detonating cords 50 were connected to the electric detonator 54. Then, the electric detonator 54 was operated to detonate the detonating cords 50 and thus the blasting explosives 20 and others, thereby blasting the outer container 60 and other components.

The result of blasting the outer container 60 and other components with the blast treatment method as described above was that, similarly with Example 1, the portion of the outer circumference of the outer container 60 where the blasting explosives 20 and the shaped explosives 70 were positioned, the inner container 40, and the shell 11 were destroyed and broken into small fragments. Further, the bursting charge 13 was decomposed. It was confirmed through measurement of the concentration of n-DBS contained in the detonation product gas and residues inside the chamber 90 that the decomposition rate was 99.99998%.

Here, in a modification of Example 2 in which water exists between the outer container 60 and the inner container 40, for example, the times to collision associated with the blasting explosives 20, the differences in the times to collision, and the detonation timings were determined using the propagation velocity of the shock waves (5 km/s) and established as indicated in table 4.

TABLE 4

| | Position of blasting explosive | | | | |
|---|---|---|---|---|---|
| | P20 | P21, P31 | P22, P30 | P23, P29 | P25, P27 |
| Time to collision [μs] | 9.5 | 9.1 | 8.1 | 7.0 | 4.5 |
| Difference in time to collision [μs] | 0.0 | 0.4 | 1.4 | 2.6 | 5.1 |
| Detonation timing [μs] | 0 | 0 | 0 | 6 | 6 |

As has been described above, the present invention provides a blast treatment method for blast-treating a treatment subject containing a treating explosive formed to extend along a specific direction, a shell that has a central axis extending along a predetermined direction and houses therein the treating explosive in an orientation where the treating explosive extends along the central axis of the shell, and a chemical agent filled so as to surround the treating explosive inside the shell. In the method, the treatment subject is housed within an outer container extending along a predetermined axial direction in an orientation where the central axis of the outer container and the central axis of the shell extend substantially parallel to each other while being displaced from each other in a direction substantially orthogonal to the central axes themselves. The method comprises a blasting explosive placement step of placing a plurality of blasting explosives used for blasting the treatment subject at positions on an exterior surface of the outer container in such a manner that the blasting explosives are spaced apart from each other in a direction surrounding the central axis of the outer container and arranged to extend substantially parallel to the central axis of the outer container, an installation step of installing, within a sealable chamber, the outer container in which the treatment subject is housed, and a blast step of detonating the plurality of blasting explosives, and causing the treatment subject to be blasted by detonation energy of the blasting explosives. Further, in the blast step, each of the blasting explosives is separately detonated at a detonation timing at which fragments of the outer container or shock waves created in a vicinity of each blasting explosive by the detonation energy of the blasting explosive collide against the shell with a temporal difference smaller than that caused when the plurality of blasting explosives are simultaneously detonated.

According to this method, the treatment subject is blast-treated by the detonation energy of each blasting explosive within the sealable chamber. Accordingly, it is unnecessary to extract the treatment subject containing the chemical agent from the outer container. Further, when the treatment subject is blasted, the chemical agent is prevented from externally diffusing. Because of these factors, the treatment subject can be treated in a safe and secure way.

Moreover, according to this method, it is possible to more securely treat the treatment subject housed within the outer container in a condition that the plurality of blasting explosives are placed at the positions on the exterior surface of the outer container whose central axis is displaced from that of the treatment subject. Specifically, in the method, the fragments of the outer container or the shock waves created at the plurality of positions along the direction surrounding the central axis of the shell collide against the shell substantially at the same time. Then, the detonation energy of each blasting explosive is uniformly exerted on the treatment subject from the surrounding areas of the treatment subject. This prevents fragments of the shell from flying toward an outside of the shell. Further, the detonation energy of each blasting explosive is effectively concentrated on the treatment subject. This ensures reliable treatment of the treatment subject. In particular, the thus-concentrated detonation energy of the blasting explosive on the treatment subject ensures the high temperature and high pressure around the chemical agent. As a result, the chemical agent is decomposed with higher certainty.

Here, it is particularly advantageous that the present invention is applied when the shell has a cylindrically-shaped outer circumferential surface extending about its central axis, and the outer container has a cylindrically-shaped outer circumferential surface extending about its central axis.

More specifically, the central axis of the outer container is not aligned with the central axis of the treatment subject. For this reason, in a case where the shell has the cylindrical circumferential surface extending about its central axis and the outer container has the cylindrical circumferential surface extending about its central axis, when each of the blasting explosives is placed on the exterior surface of the outer container, non-uniform distances are obtained between each blasting explosive and the treatment subject. In this case, it is highly likely that the detonation energy of each blasting explosive is not uniformly exerted on the treatment subject. In contrast to this, when the present invention is applied, the detonation energy of each blasting explosive can be uniformly exerted on the treatment subject by appropriately adjusting the detonation timing of each blasting explosive. In this way, secure treatment of the treatment subject can be achieved.

In this invention, the blasting explosive placement step includes a step of respectively connecting detonating cords to the blasting explosives and connecting the detonating cords to a common detonating device. Then, it is preferable that in the blast step, the detonating cords are simultaneously detonated by the detonating device, and the blasting explosives are blasted by detonation of the detonating cords, while in the blasting explosive placement step, a linear dimension of each detonating cord between the detonating device and each blasting explosive is determined to be a length with which each detonating cord detonates each blasting explosive at a detonation timing at which the fragments of the outer container or the shock waves created in the vicinity of each blasting explosive by the detonation energy of the blasting explosive collide against the shell with the temporal difference smaller than that caused when the plurality of blasting explosives are simultaneously detonated.

In this way, each of the blasting explosives can be detonated at the specified detonation timing only with a simple procedure to adjust the lengths of the detonating cords depending on the detonation timings of the blasting explosives and connect the detonating cords to the common detonating device. Further, the number of the detonating devices can be minimized.

Further, in this invention, the blasting explosive placement step preferably includes a step of placing a plurality of initiating explosives whose detonation velocities are greater than those of the blasting explosives at positions opposite to the outer container on exterior surfaces of the blasting explosives, and the blast step preferably includes a step of detonating each initiating explosive and blasting the blasting explosive by detonation energy released from the initiating explosive.

In this way, the initiating explosives are firstly detonated, to thereby inwardly orient the detonation vectors of the blasting explosives. As a result, the detonation energy of the blasting explosives can be more efficiently exerted on the outer container and the treatment subject. This further ensures that the treatment subject can be securely treated. In addition, the fragments of the shell and the chemical agent are further reliably blocked from flying outside.

Here, in a case where the initiating explosives are used for blasting the blasting explosives by means of the detonation energy of the initiating explosives, it is preferable that the blasting explosive placement step includes a step of respectively connecting the detonating cords to the initiating explosives and connecting the detonating cords to the common detonating device, while in the blast step, the detonating cords are simultaneously detonated by the detonating device, and the initiating explosives are blasted by the detonation of the detonating cords. Preferably, in the blasting explosive placement step, the linear dimension of each detonating cord between the detonating device and each initiating explosive is determined to be a length with which each initiating explosive blasted by the detonation of each detonating cord detonates each blasting explosive at a detonation timing at which the fragments of the outer container or the shock waves created in the vicinity of each blasting explosive by the detonation energy of the blasting explosive collide against the shell with the temporal difference smaller than that caused when the plurality of blasting explosives are simultaneously blasted.

In this way, each of the blasting explosives can be detonated at the specified detonation timing only with the simple procedure to adjust the lengths of the detonating cords depending on the detonation timings and connect the detonating cords to the common detonating device. In addition, the number of detonating devices can be minimized.

Further, in this invention, it is preferable to include a detonation timing setting step implemented before the blast step to set a detonation timing for each blasting explosive based on the distance from each blasting explosive to the shell and based on the type of the filling material filled between the outer container and the shell.

The length of time elapsed from detonation of the blasting explosive until detonation energy of the blasting explosive, i.e. the fragments of the outer container or the shock waves created by the detonation of the blasting explosive arrives at the shell has been known for varying depending on the separation distance between the blasting explosive and the shell and the type of the filling material in the outer container. Accordingly, when the detonation timing of each blasting explosive is established in accordance with the distance between each blasting explosive and the shell and the type of the filling material, it is further ensured that the detonation energy of the blasting explosives is uniformly exerted on the treatment subject.

Specifically, it is known that when the filling material is a gas, the fragments of the outer container fly through the gas and collide against the shell, and when the filling material is a liquid or a solid, only the shock waves collide against the shell without the fragments of the outer container dispersed to fly, or the shock waves collide against the shell before the fragments of the outer container do.

It is therefore preferable in the detonation timing setting step to additionally implement a step of determining whether or not the filling material is a gas, a step carried out, when the filling material is determined to be the gas, to set the detonation timing based on the distance from each blasting explosive to the shell and based on a speed of the fragments of the outer container created by the detonation energy of the blasting explosive, and a step carried out, when the filling material is determined to be the liquid or solid, to set the detonation timing based on the distance from each blasting explosive to the shell and based on a velocity at which the shock waves created by the detonation of the blasting explosive propagates through the filling material.

In this way, the detonation energy of each blasting explosive is uniformly exerted on the treatment subject with greater certainty.

Here, the present invention may be also applied to the treatment subject, which is stored within the outer container in a condition where the shell is stored, inside the inner container whose central axis extends along a predetermined direction, at a position substantially coaxial with the inner container. In this case, at the blast step, the treatment subject may be blast-treated while causing the fragments of the outer container or the shock waves created by detonation energy of each blasting explosive to collide against the inner container, and accordingly causing fragments of the inner container or shock waves created by the collision to collide against the shell of the treatment subject.

Still further, in this invention, the blasting explosive placement step preferably includes a step of placing a shaped explosive, in which a metallic plate extending along a specific direction is integrally formed with an explosive extending along the metallic plate functioning to cause a collision of the metallic plate for generating a metal jet in an ultrahigh pressure state along a predetermined direction, at a location outside the outer container in an orientation where the shaped explosive extends substantially parallel to the central axis of the outer container and generates the metal jet toward the central axis of the outer container. It is also preferable that the blast step includes a step of detonating the shaped explosive, and accordingly breaking the outer container and the shell by the detonation of the shaped explosive, to expose an interior side of the shell.

In this way, the shaped explosive cuts up the outer container and the shell. This exposes the chemical agent contained in the shell in a relatively easy way. As a result, the detonation energy of the blasting explosive is efficiently transferred to the chemical agent. This further ensures certain treatment of the chemical agent. Particularly, in this method, the process to expose the chemical agent and the process to blast the treatment subject containing the chemical agent using the blasting explosives are carried out in the same chamber. For this reason, the chemical agent and others are further securely kept from spreading outside. This can realize a safe disposal of the treatment subject containing the chemical agent.

In the above-described method, it is preferable that the blasting explosive placement step includes a step of placing the shaped explosive at a position spaced from the plurality of blasting explosives in the direction surrounding the central axis of the outer container, while the blast step includes a step of detonating the shaped explosive at a timing earlier than that of the blasting explosive adjacent to the shaped explosive among the plurality of blasting explosives.

In this way, it is avoided that the cutting sites of the outer container and the shell to be cut by the shaped explosive become deformed due to detonation energy of the blasting explosive before they are cut by the shaped explosive. Accordingly, the outer container and the shell can be cut more appropriately. This allows for absolute exposure of the chemical agent and thus secure treatment of the chemical agent.

Further, in the above-described method, the blasting explosive placement step preferably includes a step of placing the shaped explosive at a position where a distance from the shaped explosive to the central axis of the shell is shorter than a distance from the shaped explosive to the central axis of the outer container.

In this way, the distance between the shaped explosive and the shell is further shortened. As a result, the metal jet of the shaped explosive can be transferred to the shell more efficiently.

Here, as described above, the present invention can be applied to the treatment subject housed within the outer container in a condition that the shell is stored, inside the inner container whose central axis extends along the specific direction, at the position substantially coaxial with the inner container.

In this case, when the shaped explosive is disposed on the outside of the outer container, the outer container, the inner container, and the shell are broken by the detonated shaped explosive in the blast step to expose the interior side of the shell, and the treatment subject may be blasted while causing the fragments of the outer container or the shock waves created by detonation energy of each blasting explosive to collide against the inner container, and accordingly causing the fragments of the inner container or the shock waves created by the collision to collide against the shell of the treatment subject.

Further, when the treatment subject, which is stored inside the inner container, is further housed together with the inner container in the outer container, the fragments of the outer container or the shock waves created by detonation of the blasting explosive firstly collide against the inner container. Thereafter, the collision of the fragments of the outer container or the shock waves against the inner container creates the fragments of the inner container or the shock waves, which are caused to collide against the shell together with the fragments of the outer container or the shock waves. Thus, to achieve more uniform transfer of the detonation energy of each blasting explosive, i.e. the fragments of each of the containers and the shock waves to the treatment subject including the shell, the fragments of the outer container or the shock waves should be uniformly transferred to the inner container, firstly.

Here, when the treatment subject is contained within the inner container, it is preferable to implement, before the blast step, the detonation timing setting step of setting the detonation timing for each blasting explosive based on the type of the filling material filled between the outer container and the inner container and based on the distance from the blasting explosive to the inner container.

This further ensures that detonation energy of each blasting explosive is uniformly transferred to the treatment subject.

In the detonation timing setting step, it is preferable to implement the step of determining whether or not the filling material is a gas, a step performed, when the filling material is determined to be the gas, to set the detonation timing based on the distance from each blasting explosive to the inner container and based on the speed of the fragments of the outer container created by the detonation energy of the blasting explosive, and a step performed, when the filling material is determined to be a liquid or a solid, to set the detonation timing based on the distance from each blasting explosive and the inner container and based on the velocity at which the shock waves created through detonation of the blasting explosive propagate through the filling material.

In this way, the detonation energy of each blasting explosive is uniformly transferred to the treatment subject with greater certainty.

Moreover, the present invention includes the blast treatment device comprising a plurality of blasting explosives to blast the treatment subject, a chamber capable of sealing the outer container and the blasting explosives in a state where they are housed in the chamber, and a detonation means to separately detonate each of the blasting explosives. In the blast treatment device, the blasting explosives are respectively placed on an exterior surface of the outer container at positions where the blasting explosives are spaced apart from each other in a direction surrounding the central axis of the outer container, and arranged to extend substantially parallel to the central axis of the outer container, and the detonation means separately detonates each of the blasting explosives at a detonation timing at which the fragments of the outer container or shock waves created in the vicinity of each blasting explosive by detonation energy of the blasting explosive collide against the shell with a temporal difference smaller than that caused when the plurality of blasting explosives are simultaneously detonated.

According to this device, the fragments of the outer container or the shock waves created by the detonation of each blasting explosive at a plurality of sites in the direction surrounding the axis of the shell collide against the shell almost at the same time. In other words, detonation energy of each blasting explosive is uniformly transferred to the treatment subject from its surroundings. This prevents the fragments of the shell from flying toward an outer side of the shell. Further, the detonation energy of the blasting explosive is effectively concentrated on the treatment subject. This ensures secure treatment of the treatment subject. In particular, because the detonation energy of the blasting explosives is concentrated on the treatment subject, the surrounding areas of the chemical agent are certainly brought into the ultrahigh pressure. As a result, the chemical agent is decomposed and treated with certainty. In addition, the blast treatment is carried out within the sealable chamber. For this reason, external diffusion of the chemical agent is avoided. This actualizes safe treatment of the treatment subject.

In the above-described device, it is preferable to include the shaped explosive in which the metallic plate extending along the specific direction is integrally formed with the explosive extending along the metallic plate and functioning to cause a collision of the metallic plate for generating the metal jets of ultrahigh pressure state. Preferably, the shaped explosive is placed at a position, outside the outer container, where the shaped explosive is able to break the outer container when detonated by the detonating device in an orientation where the shaped explosive extends substantially parallel to a central axis of the outer container and generates the metal jets toward the central axis of the outer container.

According to the above constitution, the shaped explosive breaks the outer container and the shell. In this way, the chemical agent contained within the shell is exposed relatively easily. It is therefore possible to efficiently exert the detonation energy of the blasting explosive on the chemical agent. This ensures the secure treatment of the chemical agent.

Further, in the above-described device, it is preferable that the detonating means comprises the detonating cord connected to each of the blasting explosives and detonated to blast the blasting explosives, and a detonating device commonly connected from each of the detonating cords to detonate the detonating cords. Preferably, the linear dimension of each detonating cord from the detonating device to the blasting explosive is determined to be the length with which each of the detonating cords detonates each of the blasting explosives at the detonation timing at which the fragments of the outer container or the shock waves created in the vicinity of each blasting explosive by the detonation energy of the blasting explosive collide against the shell with a temporal difference smaller than that caused when all of the blasting explosives are detonated at the same time.

According to the above setting, each of the blasting explosives can be detonated at the appropriate timing only with the simple procedure to adjust the length of each of the detonating cords depending on the detonation timings of the blasting explosives and connect the detonating cords to the common detonating device. It is also possible to decrease the number of detonating devices.

The invention claimed is:

1. A blast treatment method for blast-treating a treatment subject comprising a treating explosive formed to extend along a specific direction, a shell, which has a central axis extending along a predetermined direction and houses therein the treating explosive in an orientation where the treating explosive extends along the central axis of the shell, and a chemical agent filled so as to surround the treating explosive inside the shell, the treatment subject, which is housed inside an outer container extending along a predetermined axial direction in an orientation where a central axis of the outer container and the central axis of the shell extend substantially parallel while being displaced from each other in a direction substantially orthogonal to the central axes themselves, the blast treatment method comprising:

a blasting explosive placement step of placing a plurality of blasting explosives used for blasting the treatment subject at positions on an exterior surface of the outer container in such a manner that the blasting explosives are spaced apart from each other in a direction surrounding the central axis of the outer container and arranged to respectively extend substantially parallel to the central axis of the outer container;

an installation step of installing, within a sealable chamber, the outer container in which the treatment subject is housed; and a blast step of detonating the plurality of blasting explosives, and causing the treatment subject to be blast-treated by detonation energy of the blasting explosives in the sealed chamber, wherein in the blast step, each of the blasting explosives is separately detonated at a detonation timing at which fragments of the outer container or shock waves created in a vicinity of each blasting explosive by the detonation energy of the blasting explosive collide against the shell with a temporal difference smaller than that caused when the plurality of blasting explosives are simultaneously detonated.

2. The blast treatment method according to claim 1, wherein:

the shell has a cylindrically-shaped outer circumferential surface extending about a central axis thereof;

the outer container has a cylindrically-shaped outer circumferential surface extending about a central axis thereof, and in the blasting explosive placement step, the plurality of blasting explosives are arranged along with the outer circumferential surface of the outer container.

3. The blast treatment method according to claim 1, wherein:

the blasting explosive placement step comprises a step of respectively connecting detonating cords to the blasting explosives and connecting the detonating cords to a common detonating device;

in the blast step, the detonating cords are simultaneously detonated by the detonating device, and the blasting explosives are blasted by the detonation of the detonating cords, and in the blasting explosive placement step, a linear dimension of each of the detonating cords between the detonating device and each of the blasting explosives is determined to be a length with which each of the detonating cords detonates each of the blasting explosives at a detonation timing at which the fragments of the outer container or the shock waves created in a vicinity of each blasting explosive by detonation energy of the blasting explosive collide against the shell with a temporal difference smaller, than that caused when the plurality of blasting explosives are simultaneously detonated.

4. The blast treatment method according to claim 1, wherein:

the blasting explosive placement step comprises a step of placing a plurality of initiating explosives whose detonation velocities are greater than those of the blasting explosives at positions opposite to the outer container on exterior surfaces of the blasting explosives, respectively, and the blast step comprises a step of detonating each of the initiating explosives and blasting the blasting explosives by detonation energy released from the initiating explosives.

5. The blast treatment method according to claim 4, wherein:

the blasting explosive placement step comprises a step of respectively connecting detonating cords to the initiating explosives and connecting the detonating cords to a common detonating device;

in the blast step, the detonating cords are simultaneously detonated by the detonating device, and the initiating explosives are blasted by the detonation of the detonating cords, and in the blasting explosive placement step, a linear dimension of each of the detonating cords between the detonating device and each of the initiating explosives is determined to be a length with which each of the initiating explosives blasted by the detonation of the detonating cords detonates each of the blasting explosives at a detonation timing at which the fragments of the outer container or the shock waves created in a vicinity of each blasting explosive by detonation energy of the blasting explosive collide against the shell with a temporal difference smaller than that caused when the plurality of blasting explosives are simultaneously detonated.

6. The blast treatment method according to claim 1, further comprising:

a detonation timing setting step implemented before the blast step to set a detonation timing for each blasting explosive based on both a distance from the blasting explosive to the shell and a type of a filling material filled between the outer container and the shell.

7. The blast treatment method according to claim 6, wherein:

the detonation timing setting step comprises a step of determining whether or not the filling material is a gas, a step implemented, when the filling material is determined to be a gas, to set the detonation timing based on both the distance from each blasting explosive to the shell and a speed of the fragments of the outer container created by detonation energy of the blasting explosive, and a step implemented, when the filling material is determined to be a liquid or a solid, to set the detonation timing based on both the distance from each blasting explosive to the shell and a velocity at which the shock waves created by detonation of the blasting explosive propagate through the filling material.

8. The blast treatment method according to claim 1, wherein:

the treatment subject is housed within the outer container in a condition where the shell is stored, inside an inner container whose central axis extends along a predetermined direction, at a position substantially coaxial with the inner container, and in the blast step, the treatment subject is blast-treated while causing the fragments of the outer container or the shock waves created by detonation energy of each of the blasting explosives to collide against the inner container, and accordingly causing fragments of the inner container or shock waves created by the collision to collide against the shell.

9. The blast treatment method according to claim 1, wherein:

the blasting explosive placement step comprises a step of placing a shaped explosive, in which a metallic plate extending along a predetermined direction is integrally formed with an explosive extending along the metallic plate and functioning to cause a collision of the metallic plate for generating a metal jet in an ultrahigh pressure state along a predetermined direction, at a location outside the outer container in an orientation where the shaped explosive extends substantially parallel to the central axis of the outer container and generates the metal jet toward the central axis of the outer container, and the blast step comprises a step of detonating the shaped explosive and accordingly breaking the outer container and the shell by the detonation of the shaped explosive to expose an interior side of the shell.

10. The blast treatment method according to claim 9, wherein:

the blasting explosive placement step comprises a step of placing the shaped explosive at a position spaced apart from the plurality of blasting explosives in a direction surrounding the central axis of the outer container, and the blast step comprises a step of detonating the shaped explosive at a timing earlier than that of the blasting explosive adjacent to the shaped explosive among the plurality of blasting explosives.

11. The blast treatment method according to claim 9, wherein:

the blasting explosive placement step comprises a step of placing the shaped explosive at a position where a distance from the shaped explosive to the central axis of the shell is shorter than a distance from the shaped explosive to the central axis of the outer container.

12. The blast treatment method according to claim 9, wherein:

the treatment subject is housed within the outer container in a condition where the shell is stored, inside an inner container whose central axis extends along a predetermined direction, at a position substantially coaxial with the inner container;

in the blast step, the outer container, the inner container, and the shell are broken by the detonated shaped explosive to expose an interior side of the shell, and the treatment subject is blast-treated while causing the fragments of the outer container or the shock waves created by detonation energy of each of the blasting explosives to collide against the inner container, and accordingly causing fragments of the inner container or shock waves created by the collision to collide against the shell.

13. The blast treatment method according to claim 8 or 12, further comprising:

a detonation timing setting step implemented before the blast step to set a detonation timing for each blasting explosive based on both a type of a filling material filled between the outer container and the inner container and a distance from the blasting explosive to the inner container.

14. The blast treatment method according to claim 13, wherein:

the detonation timing setting step comprises a step of determining whether or not the filling material is a gas, a step implemented, when the filling material is determined to be a gas, to set the detonation timing based on both the distance from each blasting explosive to an inner container and a speed of the fragments of the outer container created by detonation energy of the blasting explosive, and a step implemented, when the filling material is determined to be a liquid or a solid, to set the detonation timing based on both the distance from each blasting explosive to the inner container and a velocity at which the shock waves created by detonation of the blasting explosive propagate through the filling material.

15. A blast treatment device for blast-treating a treatment subject having a treating explosive formed to extend along a specific direction, a shell, which has a central axis extending along a predetermined direction and houses therein the treating explosive in an orientation where the treating explosive extends along the central axis of the shell, and a chemical agent filled so as to surround the treating explosive inside the shell, the treatment subject, which is housed inside an outer container extending along a predetermined axial direction in an orientation where a central axis of the outer container and the central axis of the shell extend substantially parallel while being displaced from each other in a direction substantially orthogonal to the central axes themselves, with the blast treatment method according to claim 1, the blast treatment device comprising:

a plurality of blasting explosives to blast the treatment subject;

a chamber capable of sealing the outer container and the blasting explosives in a state where they are housed in the chamber, and a detonating means to separately detonate each of the blasting explosives, wherein;

the blasting explosives are placed on an exterior surface of the outer container at positions where the blasting explosives are spaced apart from each other in a direction surrounding the central axis of the outer container, and arranged to extend substantially parallel to the central axis of the outer container, and the detonating means separately detonates each of the blasting explosives at a detonation timing at which the fragments of the outer container or the shock waves created in a vicinity of each blasting explosive by detonation energy of the blasting explosive collide against the shell with a temporal difference smaller than that caused when the plurality of blasting explosives are simultaneously detonated.

16. The blast treatment device according to claim 15, further comprising:

a shaped explosive in which a metallic plate extending along a predetermined direction is integrally formed with an explosive extending along the metallic plate and functioning to cause a collision of the metallic plate for generating a metal jet in an ultrahigh pressure state along a predetermined direction, wherein;

the shaped explosive is placed at a position, outside the outer container, where the shaped explosive is able to break the outer container when detonated by the detonating means, in an orientation where the shaped explosive extend substantially parallel to a central axis of the outer container and generate the metal jet toward the central axis of the outer container.

17. The blast treatment device according to claim 16, wherein:

the detonating means comprises detonating cords respectively connected to the blasting explosives and detonated to respectively blast the blasting explosives, and a detonating device commonly connected from each of the detonating cords to detonate the detonating cords, and a linear dimension of each of the detonating cords between the detonating device and each of the blasting explosives is determined to be a length with which each of the detonating cords detonates each of the blasting explosives at a detonation timing at which the fragments of the outer container or the shock waves created in a vicinity of each blasting explosive by detonation energy of the blasting explosive collide against the shell with a temporal difference smaller than that caused when the plurality of blasting explosives are simultaneously detonated.

* * * * *